US009759005B2

(12) United States Patent
Harrison et al.

(10) Patent No.: US 9,759,005 B2
(45) Date of Patent: Sep. 12, 2017

(54) PORTAL FRAME

(71) Applicant: SIMPSON STRONG-TIE COMPANY, INC., Pleasanton, CA (US)

(72) Inventors: Ian Harrison, Nottingham (GB); Abdy Kermani, Edinburgh (GB); Sana Munir, Rugby (GB)

(73) Assignee: SIMPSON STRONG-TIE COMPANY, INC., Pleasanton, CA (US)

( * ) Notice: Subject to any disclaimer, the term of this patent is extended or adjusted under 35 U.S.C. 154(b) by 0 days.

(21) Appl. No.: 14/352,427

(22) PCT Filed: Oct. 18, 2012

(86) PCT No.: PCT/GB2012/000794
§ 371 (c)(1),
(2) Date: Apr. 17, 2014

(87) PCT Pub. No.: WO2013/057464
PCT Pub. Date: Apr. 25, 2013

(65) Prior Publication Data

US 2014/0245674 A1 Sep. 4, 2014

(30) Foreign Application Priority Data

Oct. 18, 2011 (GB) ..... 1117949.6

(51) Int. Cl.
*E06B 1/00* (2006.01)
*E04B 1/26* (2006.01)
(Continued)

(52) U.S. Cl.
CPC ..... *E06B 1/003* (2013.01); *E04B 1/26* (2013.01); *E04C 3/02* (2013.01); *E04C 3/12* (2013.01);
(Continued)

(58) Field of Classification Search
CPC ..... E04F 2001/2684; E04B 1/2608; E04B 1/2403; E04B 1/26; E04B 2001/2684;
(Continued)

(56) References Cited

U.S. PATENT DOCUMENTS 1,355,657 A 10/1920 Dryfoos
2,365,501 A 12/1944 Walstrom
(Continued)

FOREIGN PATENT DOCUMENTS

EP 2769030 A1 8/2014
FR 2304732 A1 10/1976
(Continued)

OTHER PUBLICATIONS

Wood Strong-Wall: Garage Portal Systems on Concrete Foundations, pp. 47-49, 2007 (http://www.buildsite.com/pdf/simpsonstrongtie/Wood-Strong-Wall-Shearwall-Product-Data-307376.pdf) ('Publication A').*
(Continued)

*Primary Examiner* — James Ference
(74) *Attorney, Agent, or Firm* — Vierra Magen Marcus LLP

(57) ABSTRACT

A portal frame comprising at least one header, at least a first column, at least one frame connector for rigidly connecting the at least first column to the at least one header, at least one header fastener configured to fasten the frame connector to the at least one header and at least one column fastener configured to fasten the frame connector to the at least first column. The at least first column is formed of wood or a wood-based/wood-derived material. The at least one frame connector comprises a lateral header connecting portion extending beyond a lateral edge of the first column in a direction towards the center of the at least one header and a column connecting portion extending along at least a portion
(Continued)

of the height of the at least first column. The lateral header connecting portion comprises at least one of the at least one header fastening means.

24 Claims, 29 Drawing Sheets

(51) Int. Cl.
*E04C 3/38* (2006.01)
*E04C 3/42* (2006.01)
*E04C 3/02* (2006.01)
*E04C 3/12* (2006.01)

(52) U.S. Cl.
CPC ..... *E04C 3/38* (2013.01); *E04C 3/42* (2013.01); *E04B 2001/2644* (2013.01); *E04B 2001/2684* (2013.01); *E04B 2001/2696* (2013.01); *E04C 2003/023* (2013.01)

(58) Field of Classification Search
CPC ..... E04B 2001/2696; E04C 2003/023; E04C 3/02; E04C 3/12; E04C 3/38; E04C 3/42; E06B 1/003
USPC ..... 52/295, 167.3, 712, 655.1, 656.2, 713
See application file for complete search history.

(56) References Cited

U.S. PATENT DOCUMENTS 2,666,238 A * 1/1954 Hagedorn ..... 403/189
2,704,868 A * 3/1955 Danielson ..... 52/210
4,209,265 A * 6/1980 Moehlenpah ..... 403/230
4,730,971 A 3/1988 Lin
4,812,075 A * 3/1989 Lavin, Sr. ..... A47B 96/06 403/205
5,331,786 A * 7/1994 Lippert ..... E04C 3/38 403/205
5,697,725 A * 12/1997 Ballash et al. ..... 403/231
5,706,626 A * 1/1998 Mueller ..... 52/800.12
6,088,989 A * 7/2000 Matsu ..... A47B 47/04 52/36.5
6,308,469 B1 * 10/2001 Leung ..... 52/167.3
6,327,823 B1 * 12/2001 Emms ..... E04B 1/2403 52/222
6,453,634 B1 * 9/2002 Pryor ..... 52/713
6,550,200 B1 * 4/2003 Mueller ..... 52/296
6,560,940 B2 * 5/2003 Mueller ..... 52/295
6,761,001 B2 * 7/2004 Mueller ..... 52/167.3
7,065,932 B2 * 6/2006 Roesset et al. ..... 52/712
8,001,734 B2 * 8/2011 Pryor ..... E04B 1/2403 52/167.3
2002/0002806 A1 * 1/2002 Commins et al. ..... 52/481.1
2002/0108325 A1 * 8/2002 Hulls et al. ..... 52/204.1
2003/0031077 A1 * 2/2003 Emms ..... E04B 1/2403 365/230.03
2005/0005561 A1 * 1/2005 Hanson ..... E04B 1/24 52/633
2005/0055897 A1 * 3/2005 Commins ..... E04B 1/26 52/169.1
2005/0108986 A1 * 5/2005 Cloyd ..... E04B 1/10 52/782.1
2005/0155314 A1 7/2005 Banta
2006/0037256 A1 * 2/2006 Pryor ..... 52/167.1
2006/0193687 A1 8/2006 Ghosh
2007/0028542 A1 * 2/2007 Lafferty, III ..... E04B 1/26 52/293.3
2008/0148678 A1 6/2008 Wolf
2009/0084056 A1 * 4/2009 Robertson ..... E04B 1/2604 52/396.05
2010/0018151 A1 * 1/2010 Hiriyur ..... E04B 1/24 52/656.2

FOREIGN PATENT DOCUMENTS

GB 2026124 A 1/1980
JP H08260568 A 10/1996
WO 00/50704 A1 8/2000
WO 2013/057464 A1 4/2013

OTHER PUBLICATIONS

Office Action dated Nov. 11, 2016, in European Patent Application No. 127807725.
Combined Search and Examination Report dated Dec. 16, 2011, in Application No. GB1117949.6.
Examination Report dated Apr. 25, 2014, in Application No. GB1117949.6.
Examination Report dated Nov. 26, 2014, in Application No. GB1117949.6.
Combined Search and Examination Report dated Nov. 25, 2014, in Application No. GB1417089.8.
Examination Report dated Apr. 8, 2015, in Application No. GB1417089.8.
International Search Report and Written Opinion dated Apr. 2, 2013, in International Application No. PCT/GB2012/000794 filed Oct. 18, 2012.
International Preliminary Report on Patentability dated Apr. 22, 2014, in International Application No. PCT/GB2012/000794 filed Oct. 18, 2012.

* cited by examiner

PORTAL FRAME

The present invention relates to a portal frame and, in particular, to a wooden portal frame.

Portal frames are used in construction to frame openings in a panel or other wall-like structure, such as a door, window or garage door, for example. The portal frame must resist forces which result from lateral forces exerted on a building or structure, for example those occurring due to wind loading. The absence of structural materials in the portal opening necessitates a higher level of resistance to forces received or imposed on the portal frame when compared, for example, to a wall panel frame.

The use of steel portal frames in timber framed constructions is known. For example, U.S. patent application Ser. No. 12/178,078 (published as US 2010/0018151 A1) describes a steel portal frame comprising a pair of steel shearwalls and a header. However, steel frames provide thermal bridges which conduct heat from a warmer side to a colder side, and therefore reduce the energy efficiency of a timber frame construction. Further, the steel components do not match the shrinkage of the timber components, giving rise to detrimental relative movements between respective steel and timber components. The use of steel portal frames also increases the cost of construction. Timber, on the other hand, can be sustainably sourced and provides aesthetic benefits. Timber is also more conducive to fixing methods used with timber frame constructions.

The Simpson Strong-Tie "Wood Strong-Wall Garage Portal System" of the present applicant, and known in the art, comprises one or more shearwall panels and a header formed from timber. Lateral loads received on the building and experienced by the portal frame are designed to be resisted at the base of the column by holdowns and anchor bolts, i.e. a substantially rigid connection at the base between the columns and the supporting foundation. In order to provide sufficient resistance to the loading, the foundation on which the portal frame is supported must be of a bespoke construction, and one which differs from that commonly used for timber frame constructions. This adds complexity (and cost) since it is usual for strip foundations to be constructed as an entire entity for the building, prior to arrival on site of the timber frame, where there is no requirement for a length (or lengths) of specialised cross section in that foundation where a portal frame is envisaged.

U.S. patent application Ser. No. 11/333,294 (published as US 2006/0193687 A1) describes a moment resisting connector for providing rigidity and resisting lateral loads in moment frames. This shape of connector requires fabrication (e.g. welding), has fixed dimensions, envelops the ends of the column and header and is fabricated from metal. As a result, the problem of thermal bridging again occurs, as does the problem of detrimental relative movements between respective steel and timber components. The use of metal also increases the cost of construction. The over-engineering of the connector (relative to the column) results in all force loading and movement being transferred to the header and columns, with a sudden transition zone from connector to header or column, and this can cause failure at points of force and bending concentrations, typically immediately adjacent to the openings of the connector which envelop the ends of the column and header. Furthermore, the fixed dimensions of the fabricated section limit use of any one connector to the connection of a single size of header and column, increasing the range of different connector sizes which must be produced in order to accommodate different sizes of header and column, and/or compromising the structural integrity of a connection where the connector does not exactly fit the dimensions of each of the column and header.

U.S. patent application Ser. No. 10/637,444 (published as US 2004/0154258 A1) describes a structure comprising an "active" mechansim which is moved or deformed in response to loading of a frame. This does not provide for a rigid frame which resists loading in the manner of a portal frame.

The present invention addresses the above problems experienced in the art.

According to a first aspect, the present invention provides a portal frame comprising:

at least one header;

at least a first column;

at least one frame connector for rigidly connecting the at least first column to the at least one header;

at least one header fastening means for fastening the frame connector to the at least one header;

at least one column fastening means for fastening the frame connector to the at least first column, wherein:

the at least first column is formed of wood or a wood-based/wood-derived material, and the at least one frame connector comprises:

a lateral header connecting portion extending beyond a lateral edge of the first column in a direction towards the centre of the at least one header; and a column connecting portion extending along at least a portion of the height of the at least first column, wherein:

the lateral header connecting portion comprises at least one of the at least one header fastening means.

According to a second aspect, the present invention provides a column for use as the at least one first column and/or at least second column in a portal frame as set forth herein.

According to a third aspect, the present invention provides a method of forming a portal frame as set forth herein and comprising the step of:

fastening the at least first column to the at least one header using the frame connector.

According to a fourth aspect, the present invention provides a frame connector for use in a portal frame as set forth herein wherein the frame connector comprises:

a lateral header connecting portion extending in use beyond a lateral edge of the first column in a direction towards the centre of the at least one header; and a column connecting portion extending in use along at least a portion of the height of the at least first column.

Preferred embodiments of the present invention will now be described by way of example only with reference to the accompanying drawings, in which.

Figure 1:
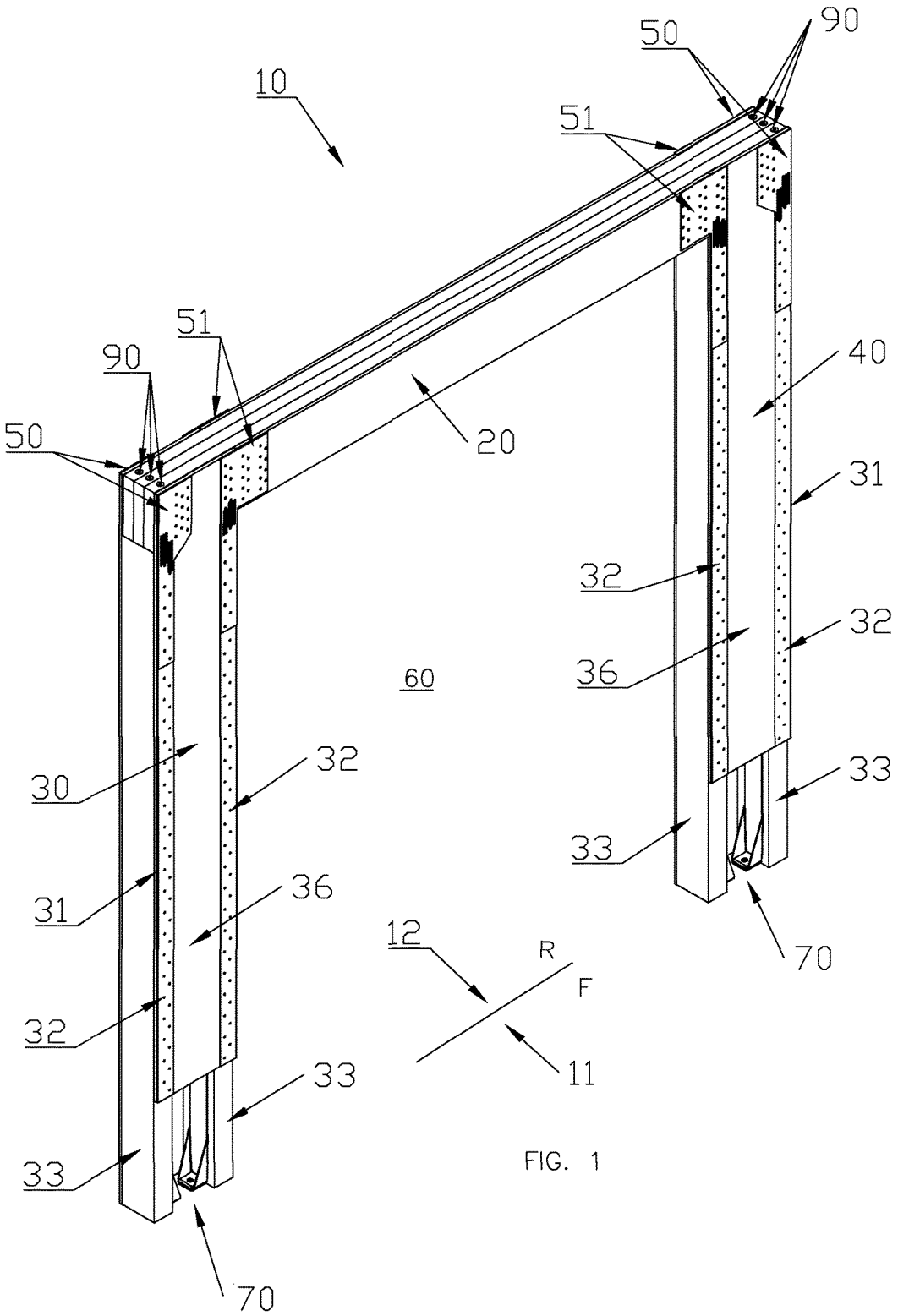
FIG. 1 is a schematic perspective view of a portal frame according to a first preferred embodiment of the present invention.
Figure 3A:
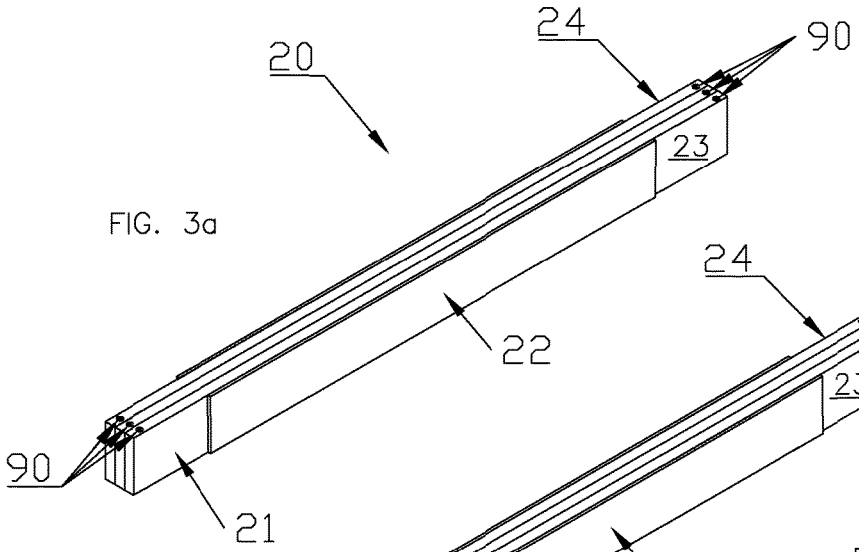
Figure 3B:
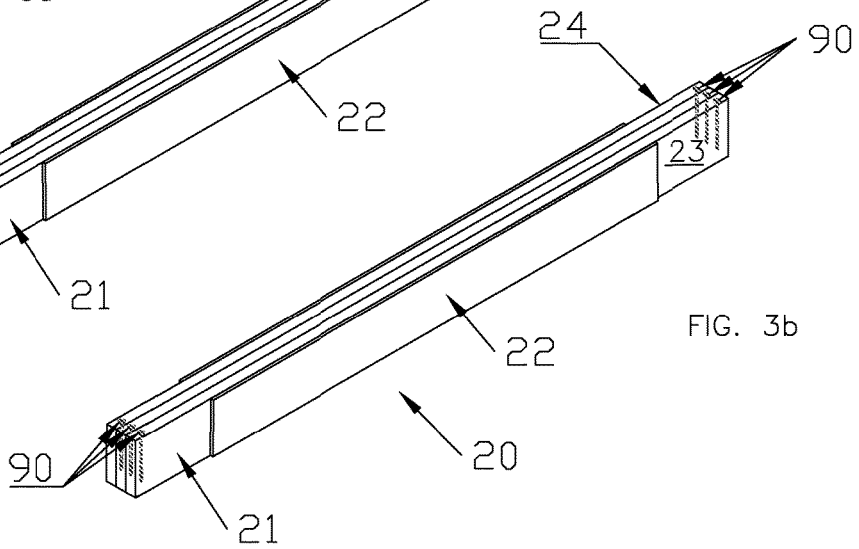
Figure 3C:
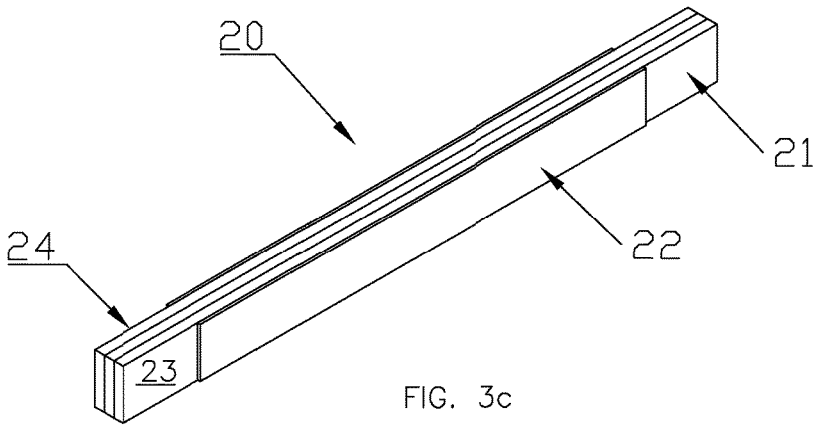
Figure 4:
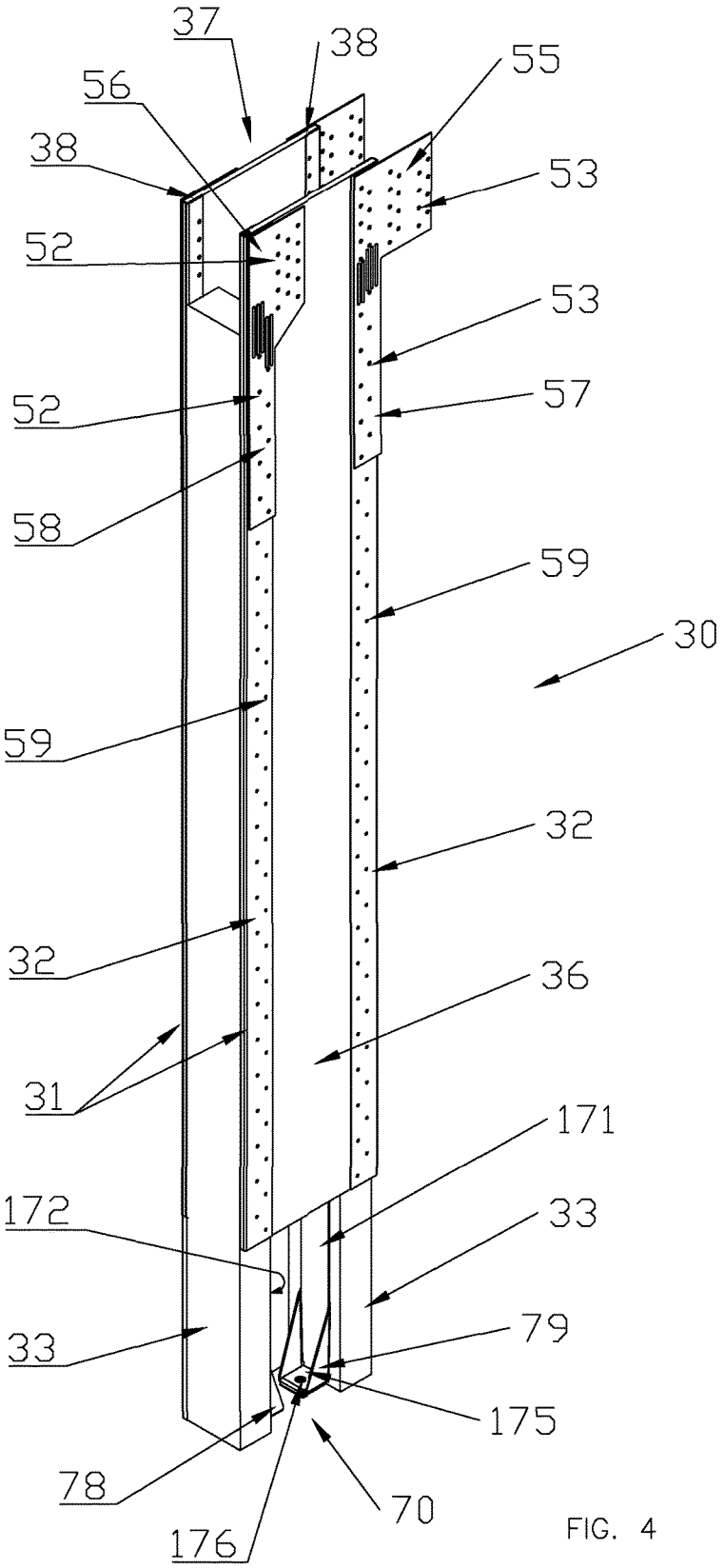
Figure 5:
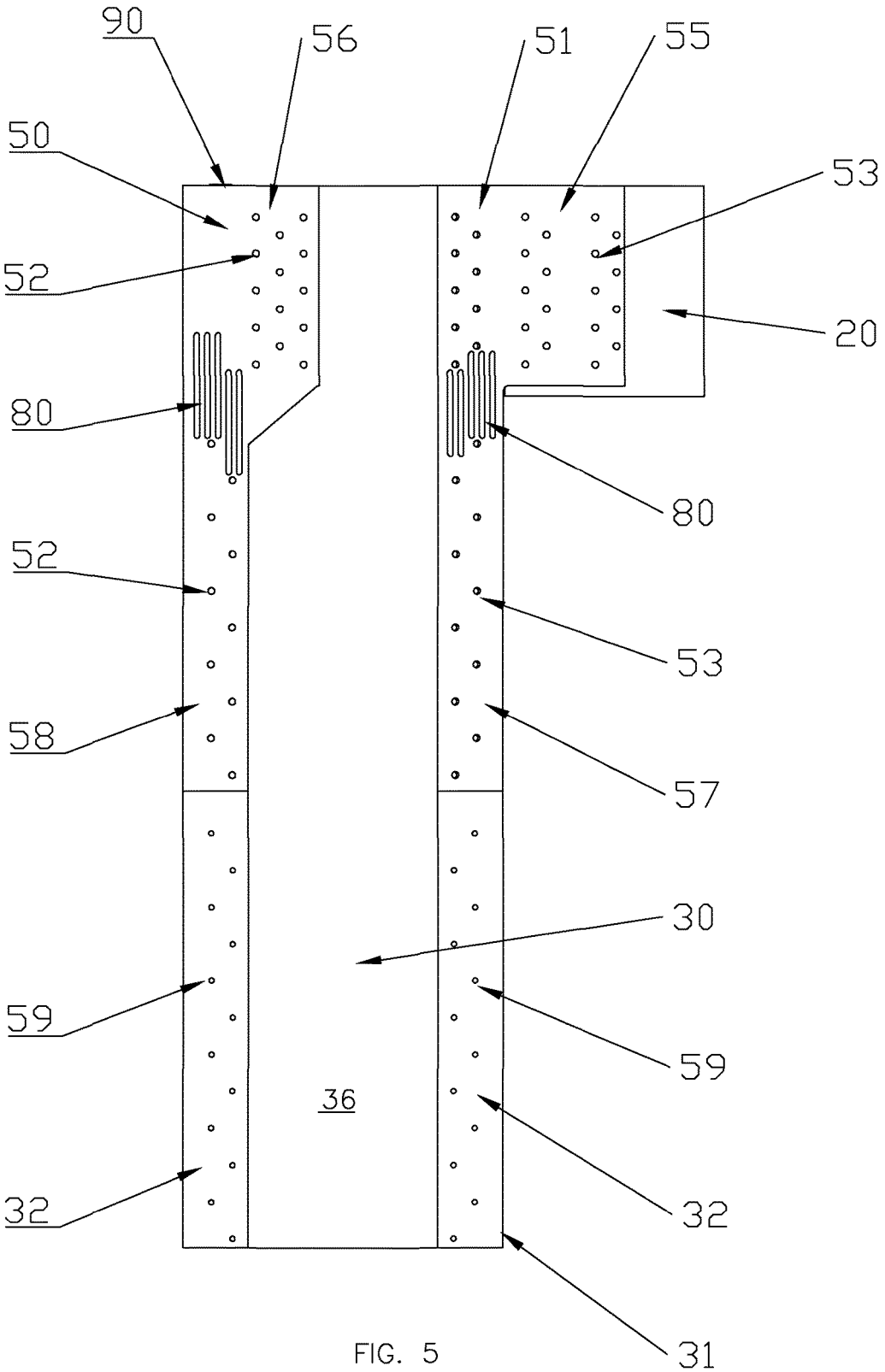

FIGS. 3*a* to 3*c* are schematic perspective views of a header of the portal frame of FIG. 1;

FIG. 4 is a schematic perspective view of a first column of the portal frame of FIG. 1;

FIG. 5 is a schematic detailed front elevation view of the upper left hand end of the portal frame of FIG. 1.

Figure 6A:
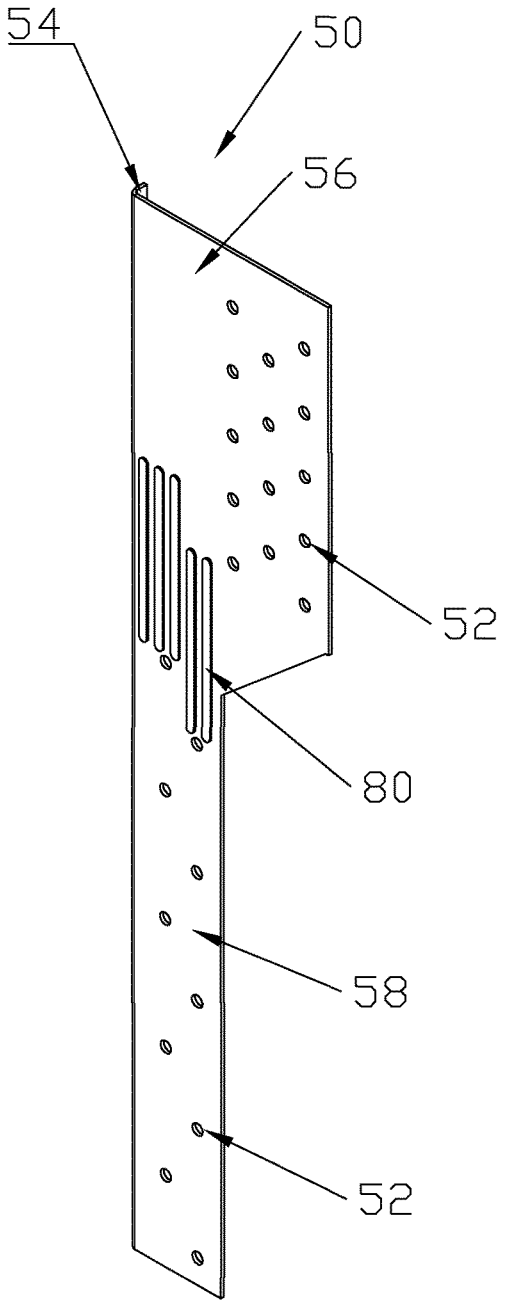
Figure 6B:
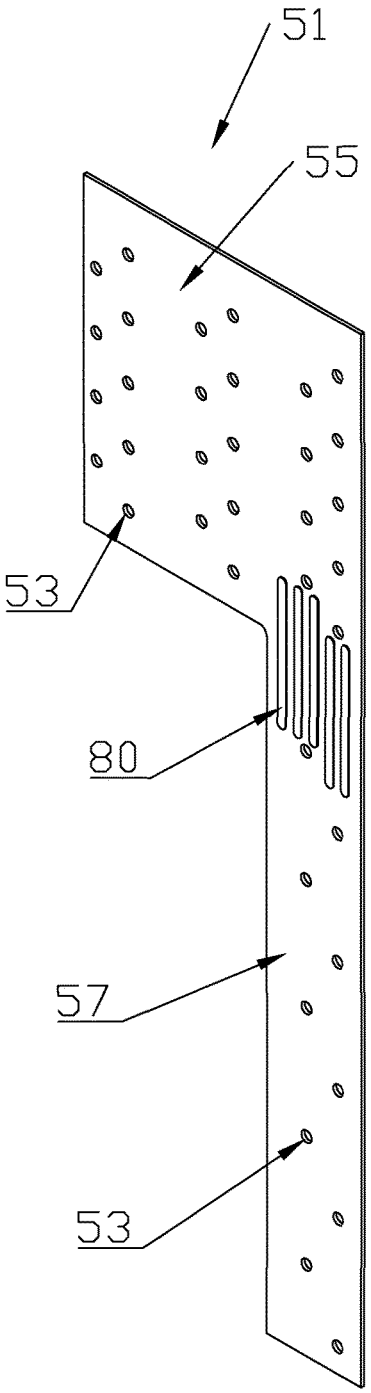
Figure 6C:
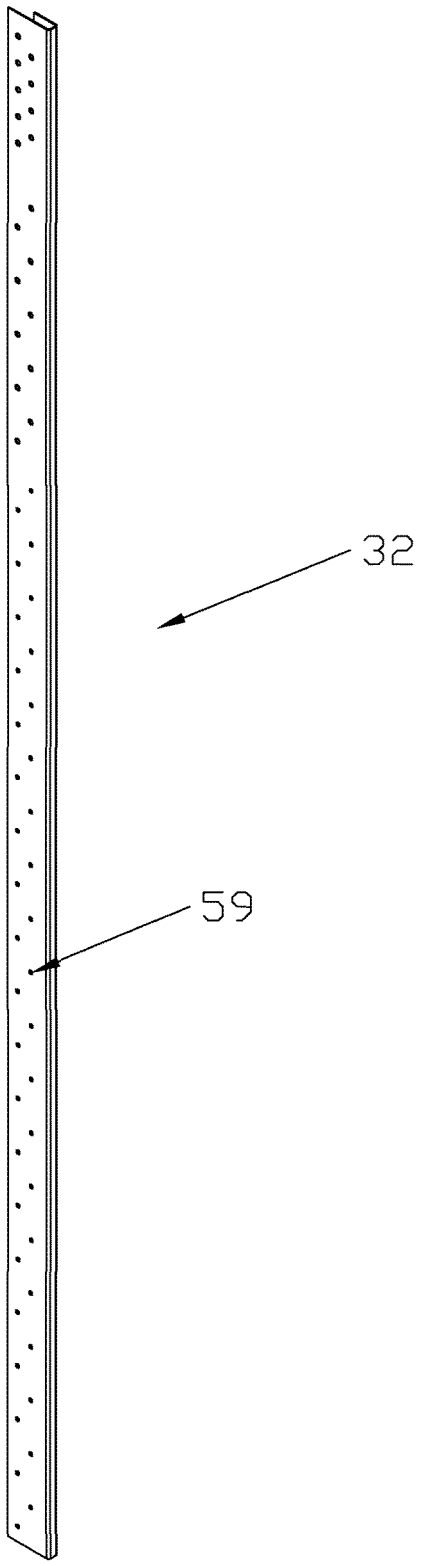
Figure 7A:
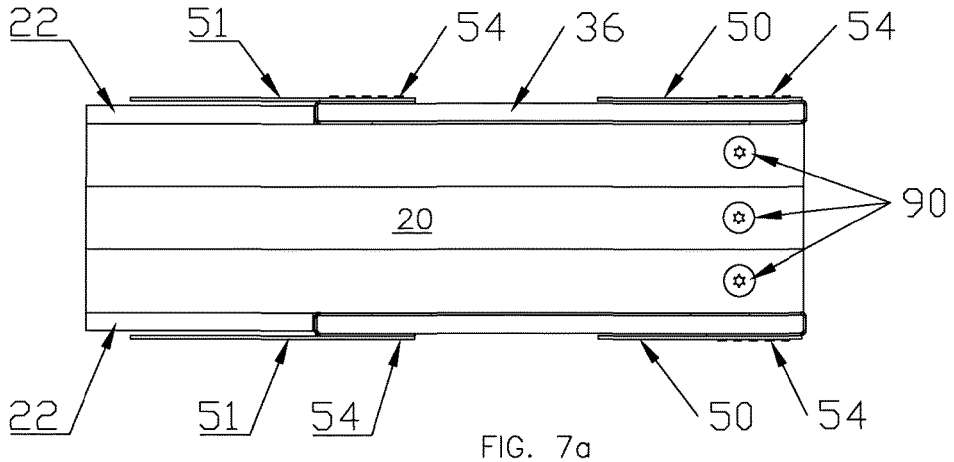
Figure 7B:
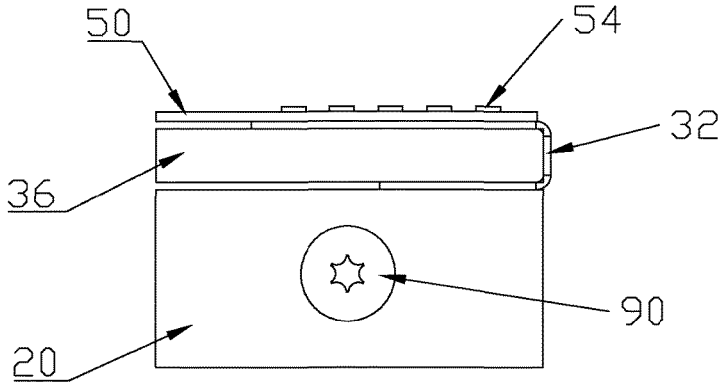

FIGS. 6*a* and 6*b* are schematic perspective views of respective outer and inner frame connectors of the portal frame of FIG. 1;

FIG. 6*c* is a schematic perspective view of an edging strip of the portal frame of FIG. 1;

FIG. 7*a* is a schematic detailed plan view from above of a right hand end of the portal frame of FIG. 1;

FIG. 7*b* is an enlarged schematic detailed plan view from above of a part of the right hand end of the portal frame shown in FIG. 7*a;*

Figure 7C:
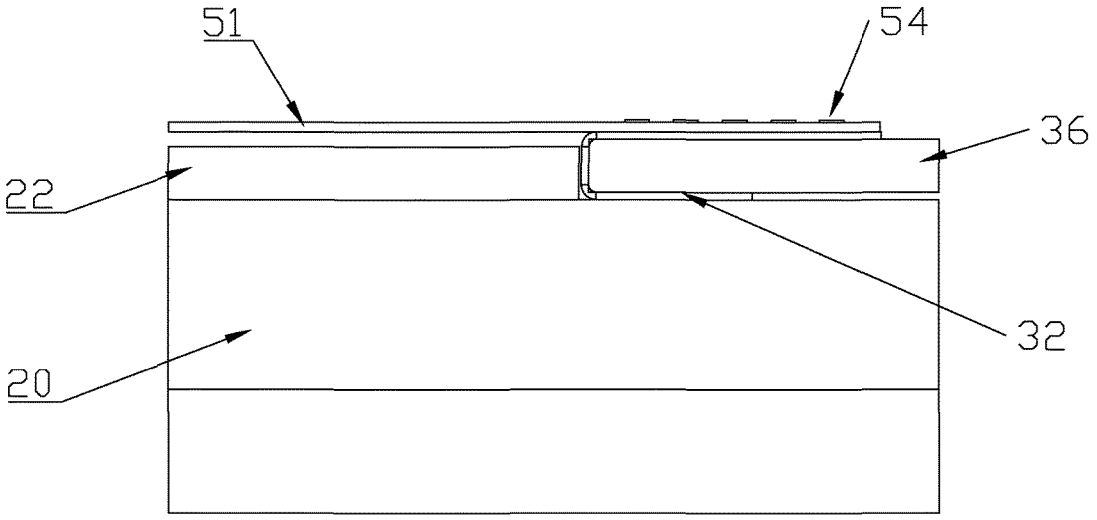

FIG. 7*c* is an enlarged schematic detailed plan view from above of a part of the right hand end of the portal frame shown in FIG. 7*a;*

Figure 8A:
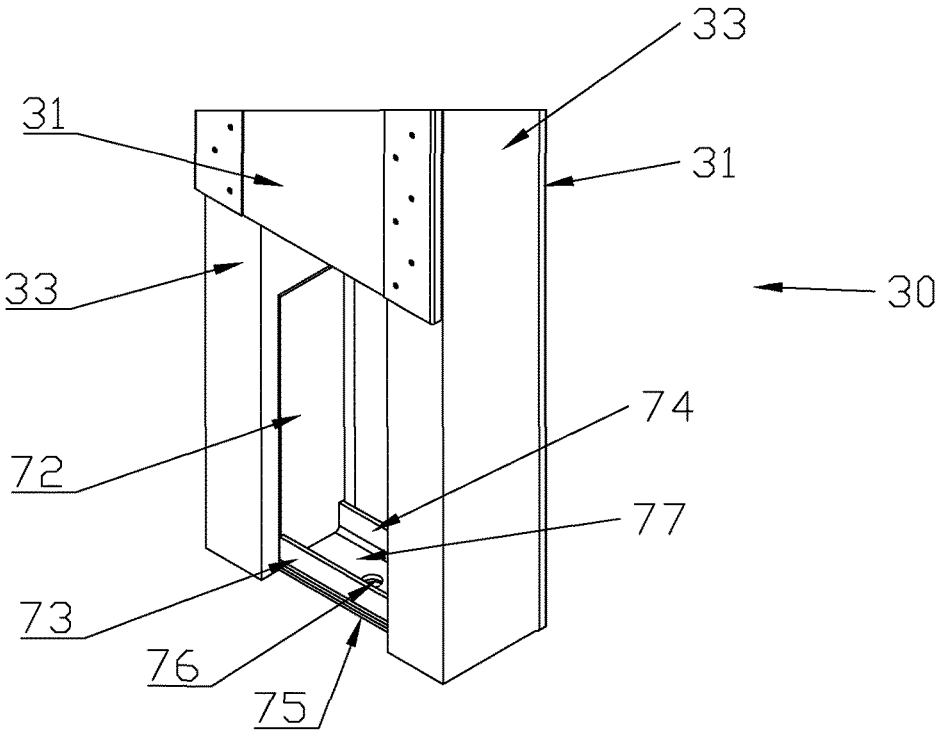
Figure 8B:
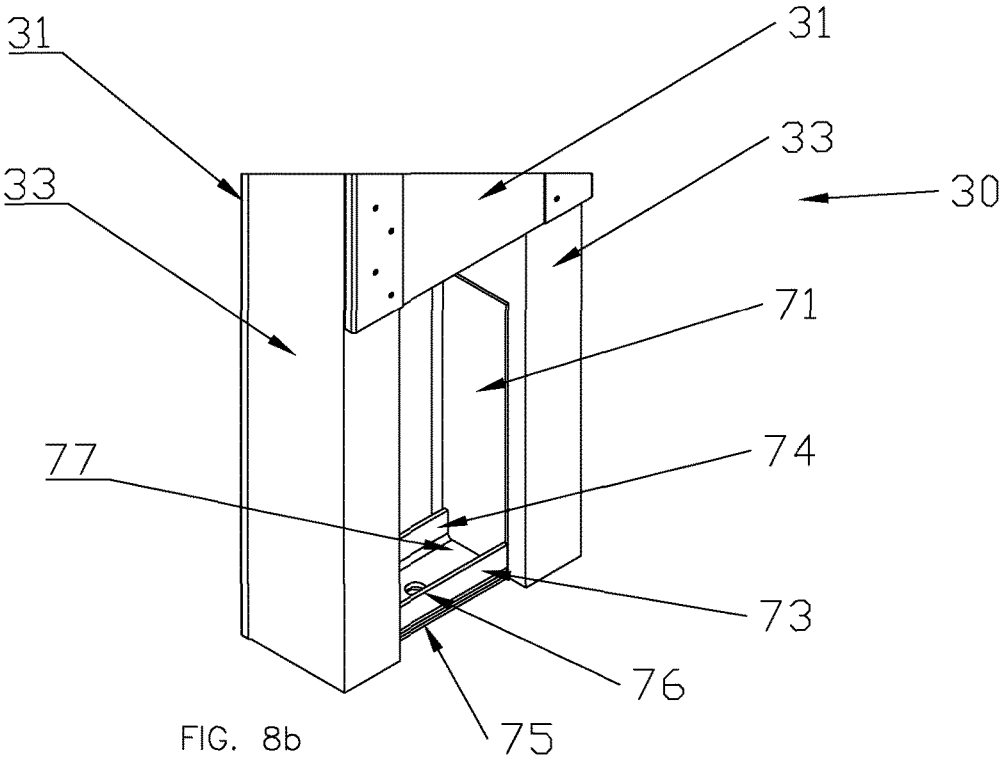
Figure 9A:
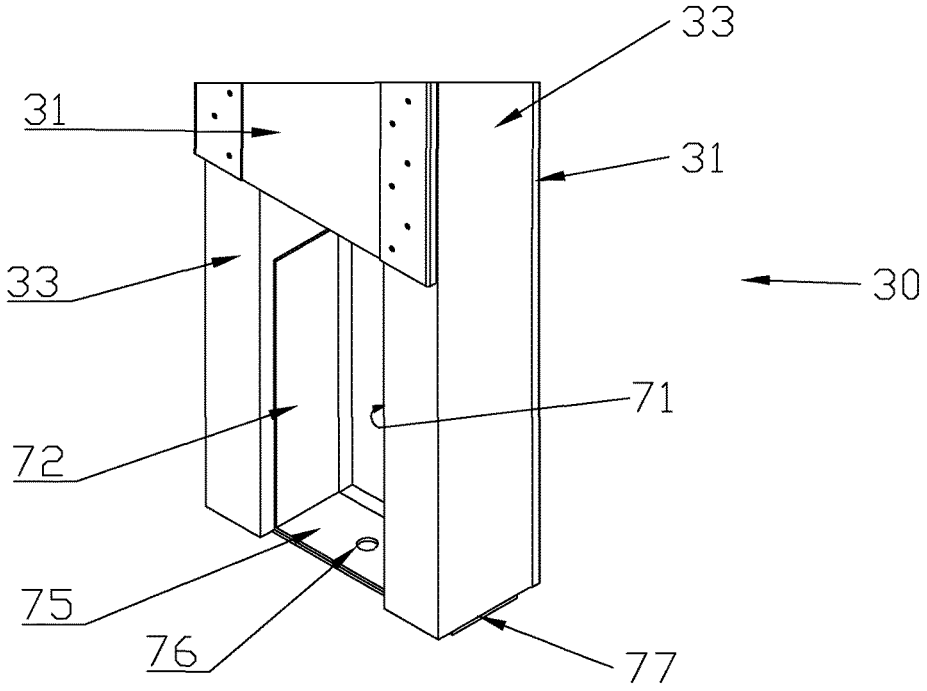
Figure 9B:
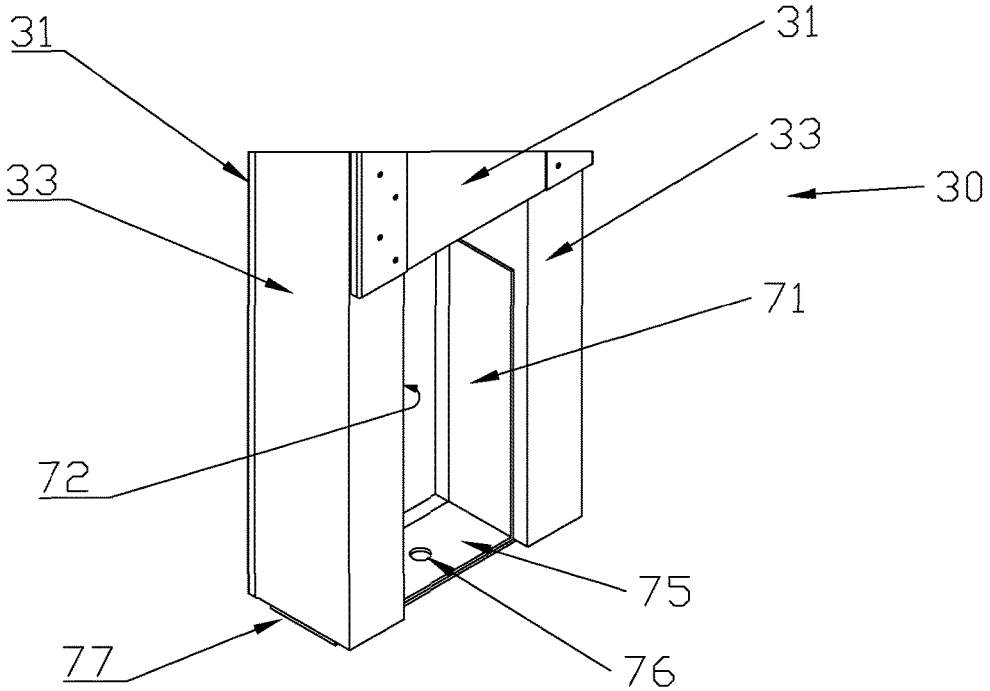
Figure 10A:
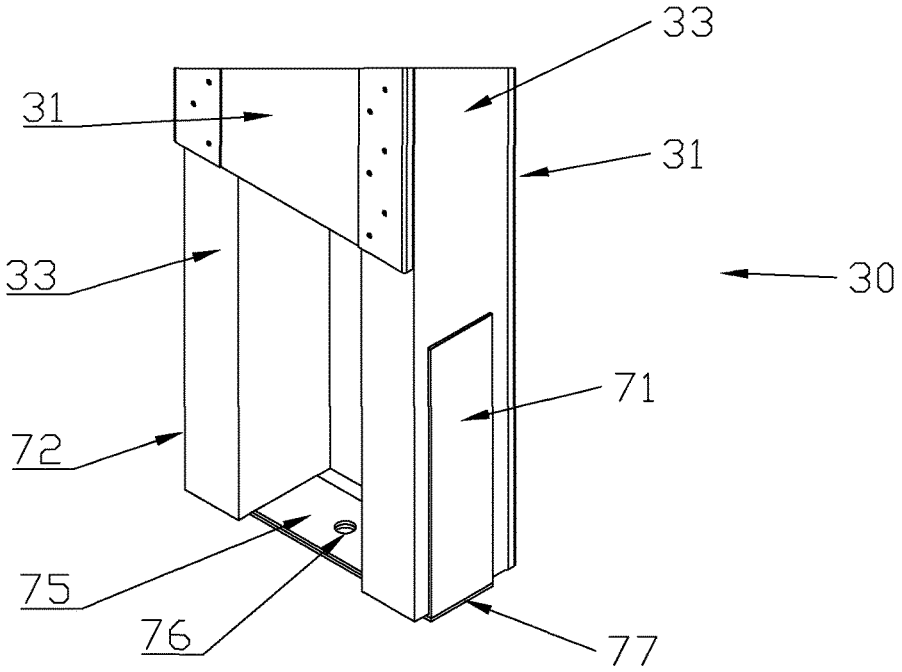
Figure 10B:
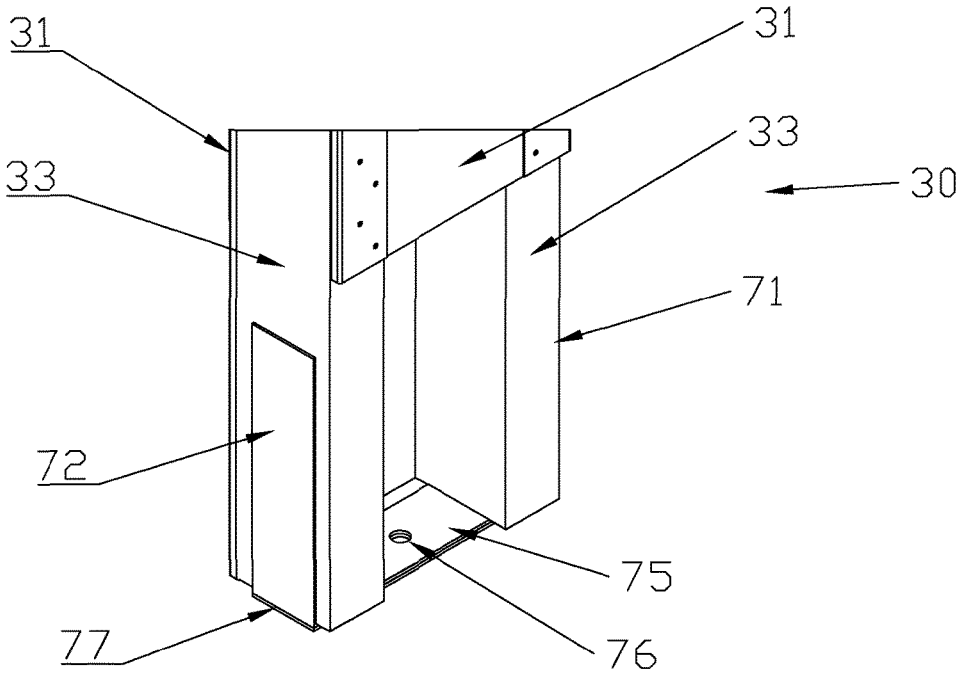
Figure 11A:
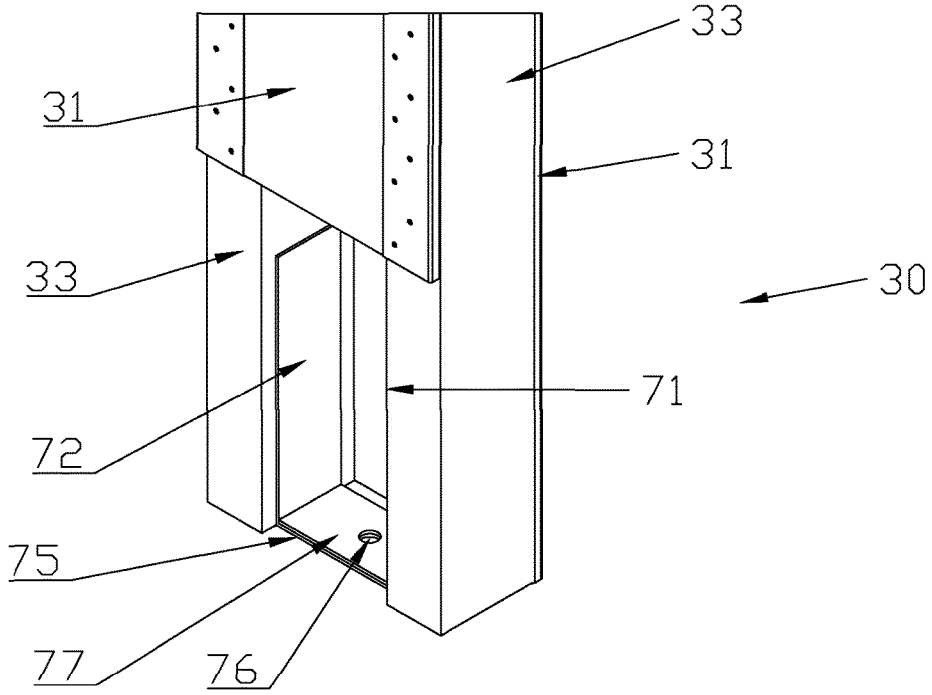
Figure 11B:
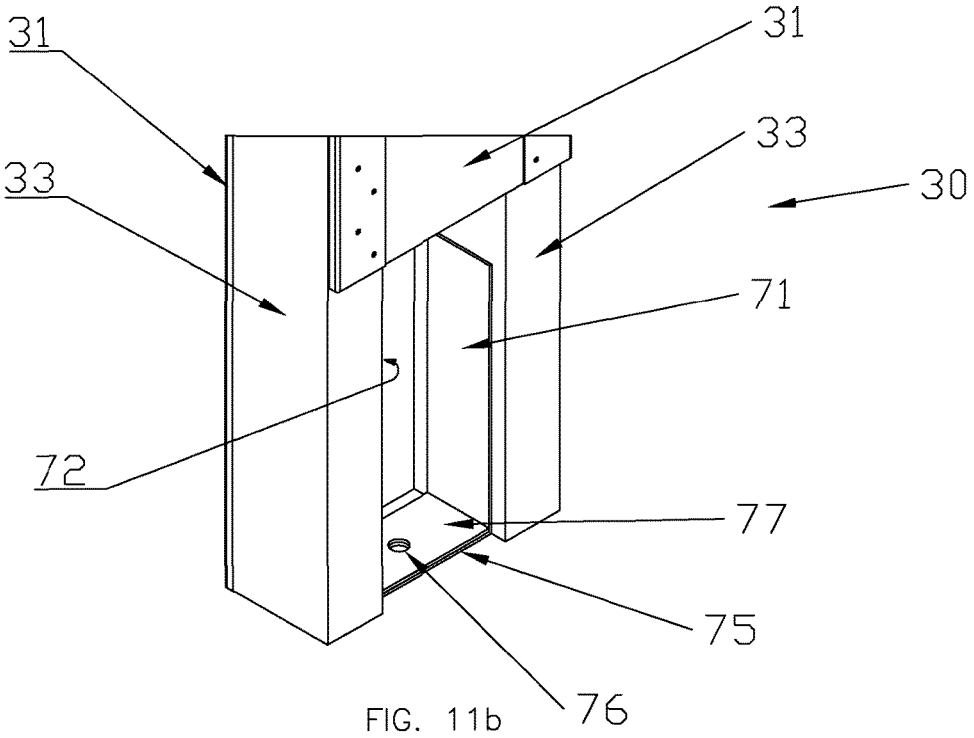
Figure 12A:
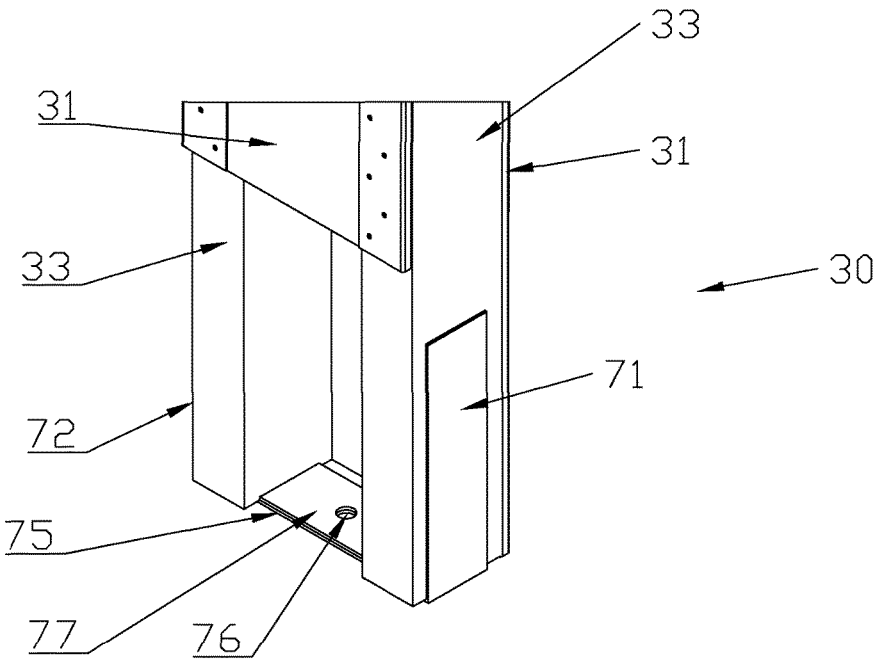
Figure 12B:
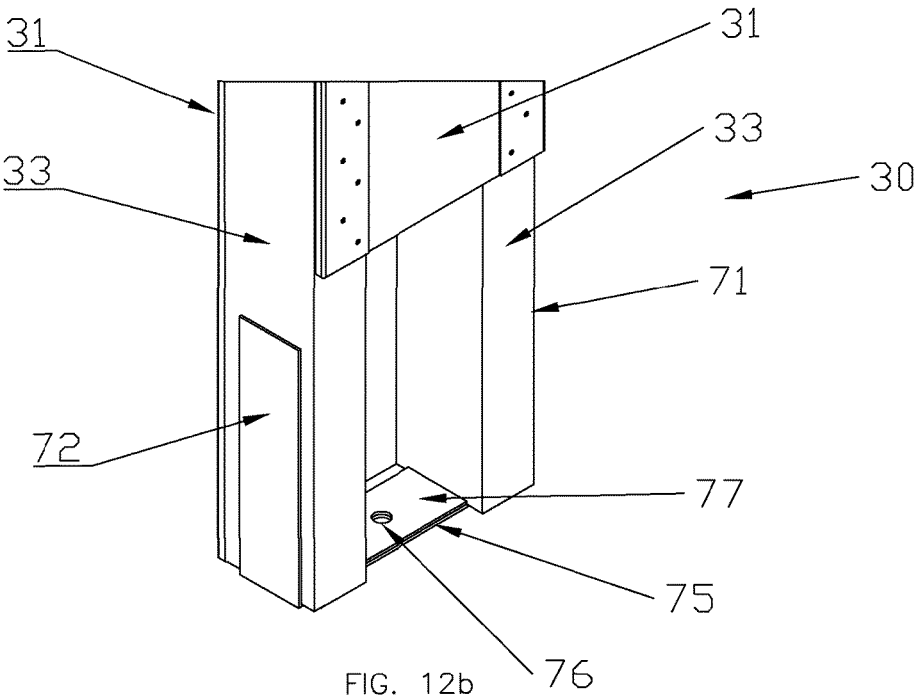
Figure 13:
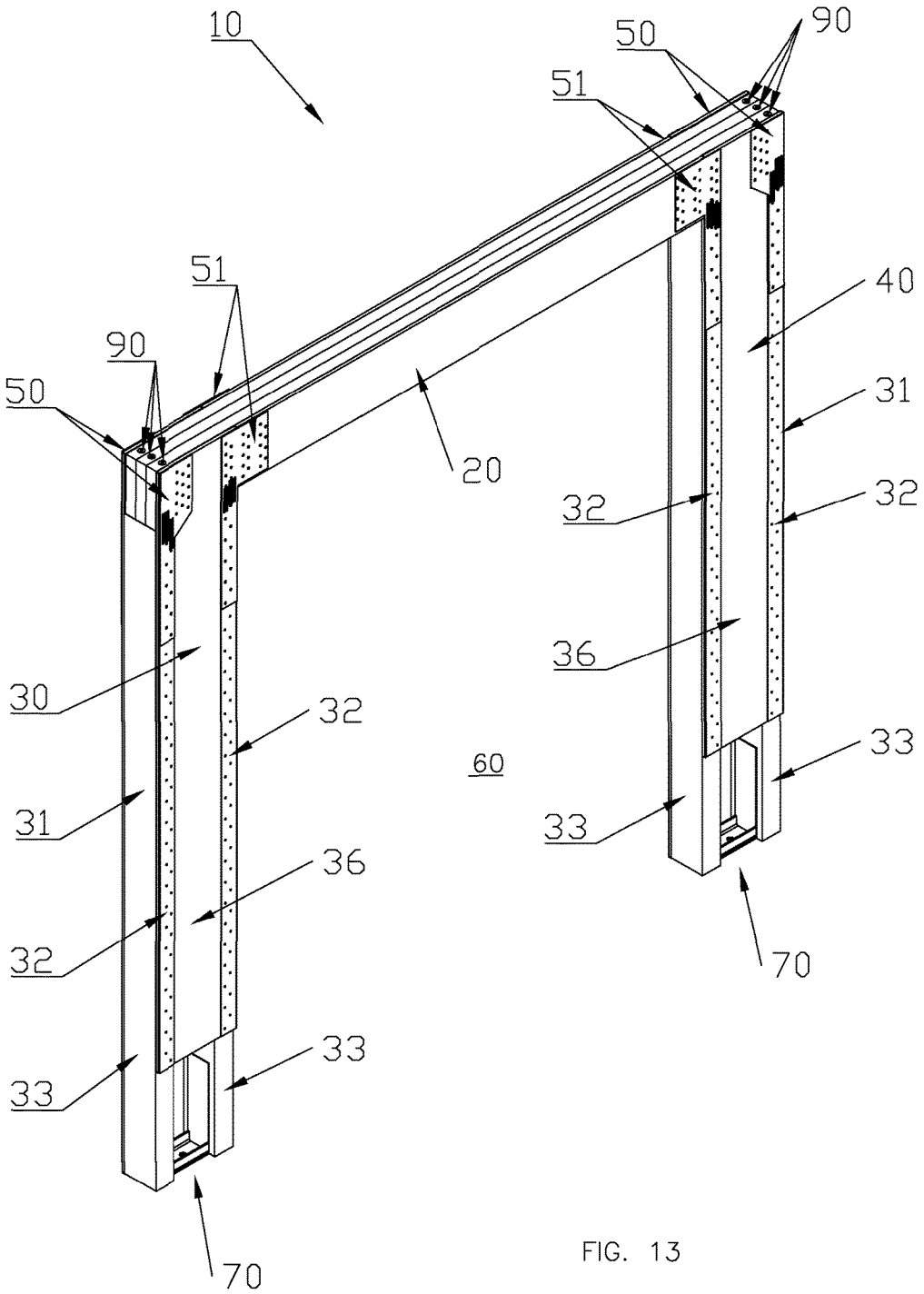
Figure 14:
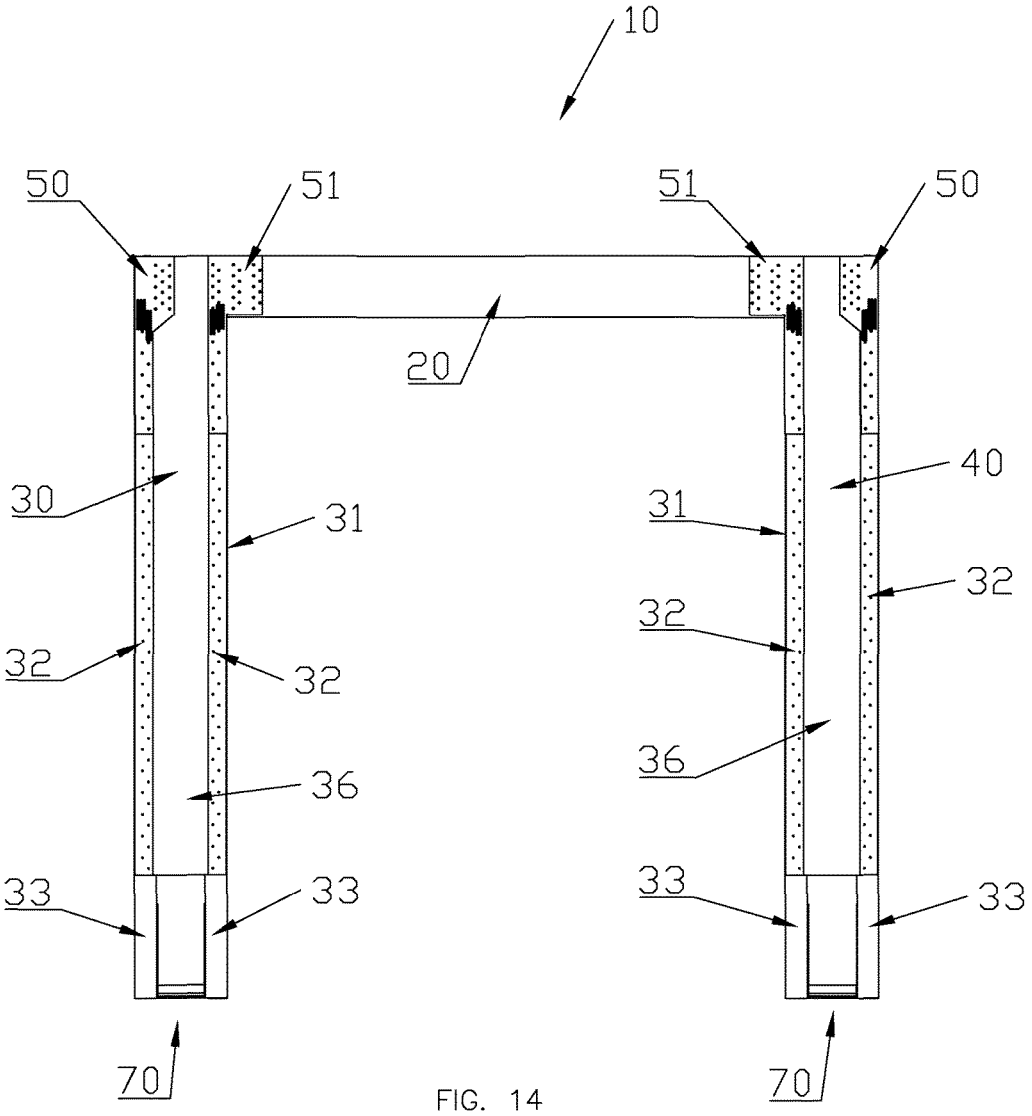
Figure 15:
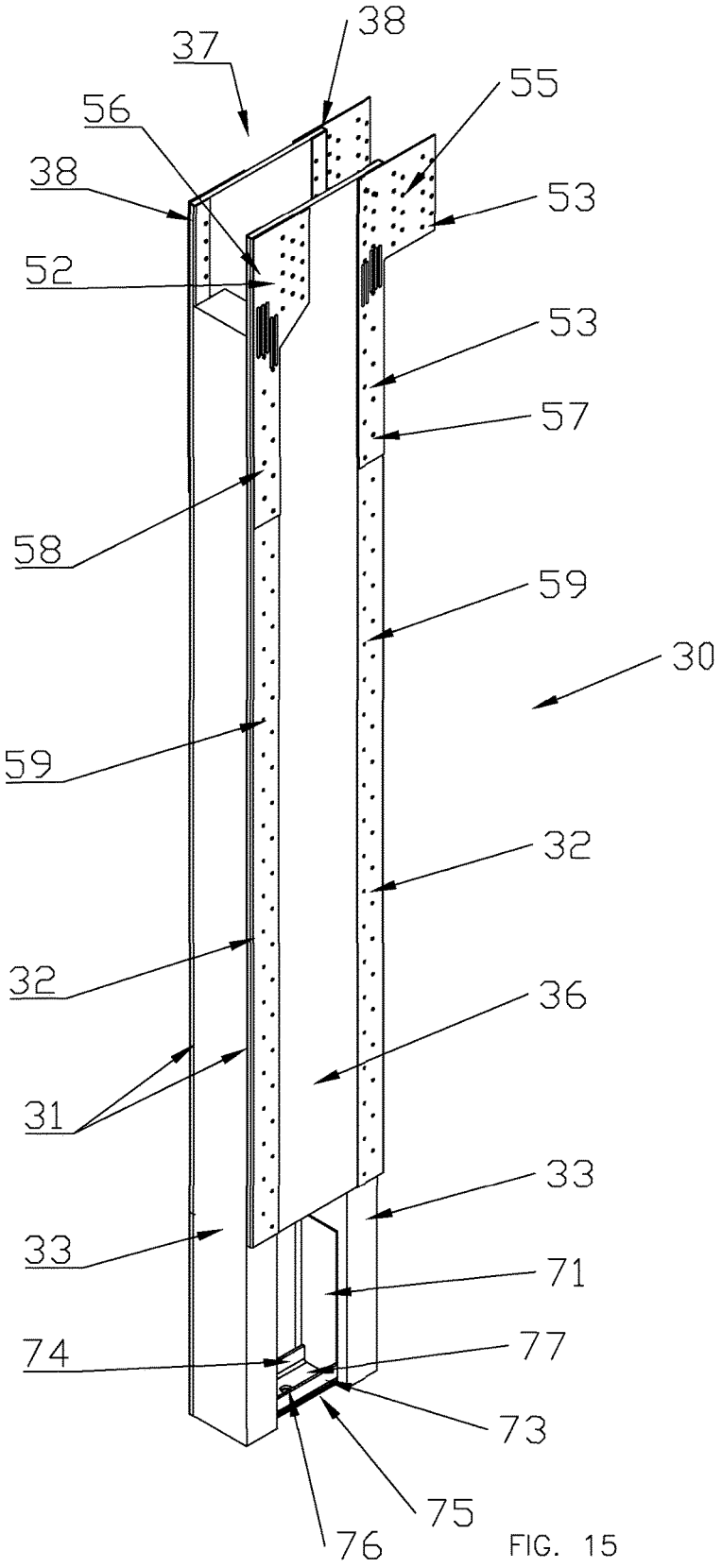
Figure 16:
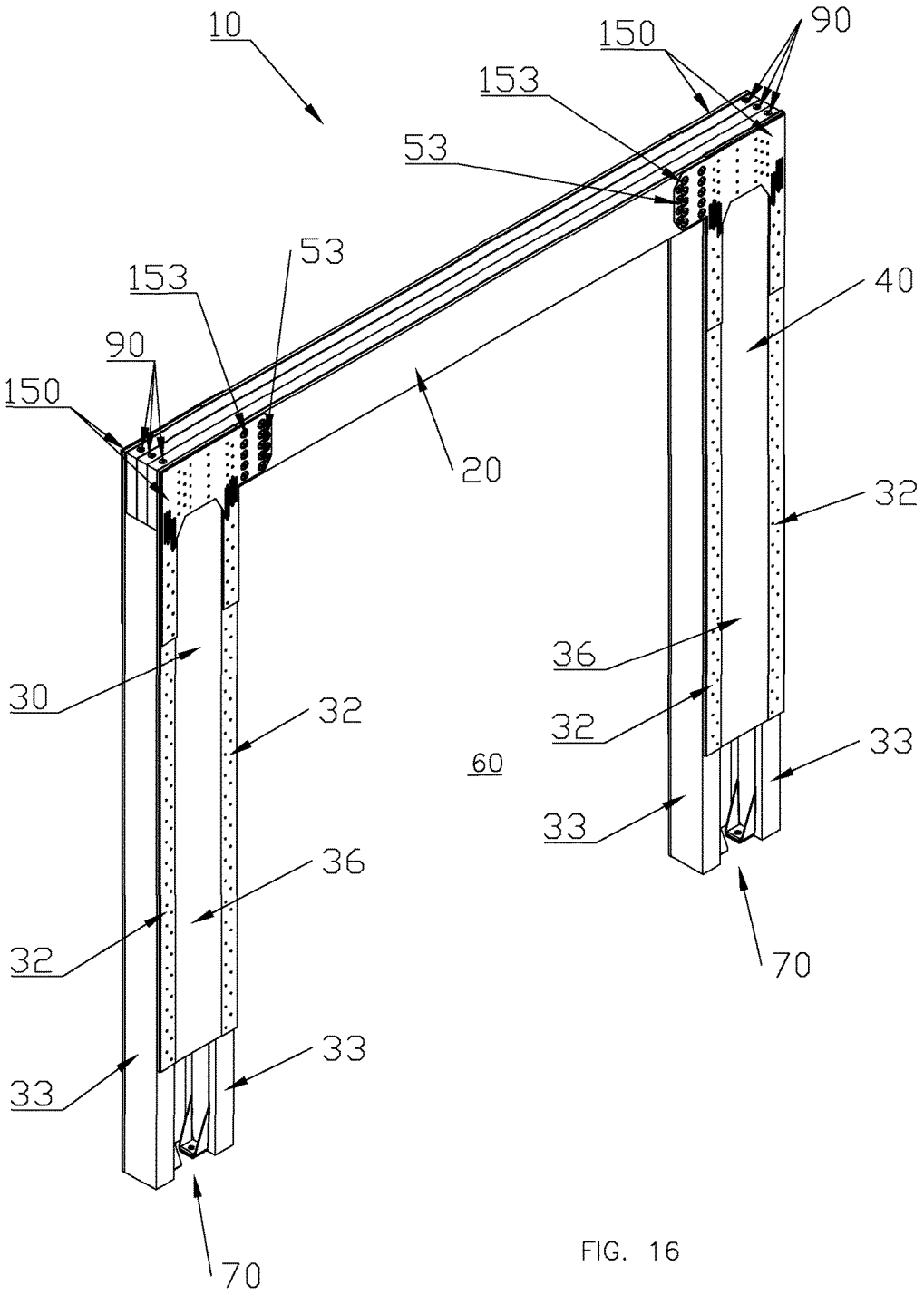
Figure 17:
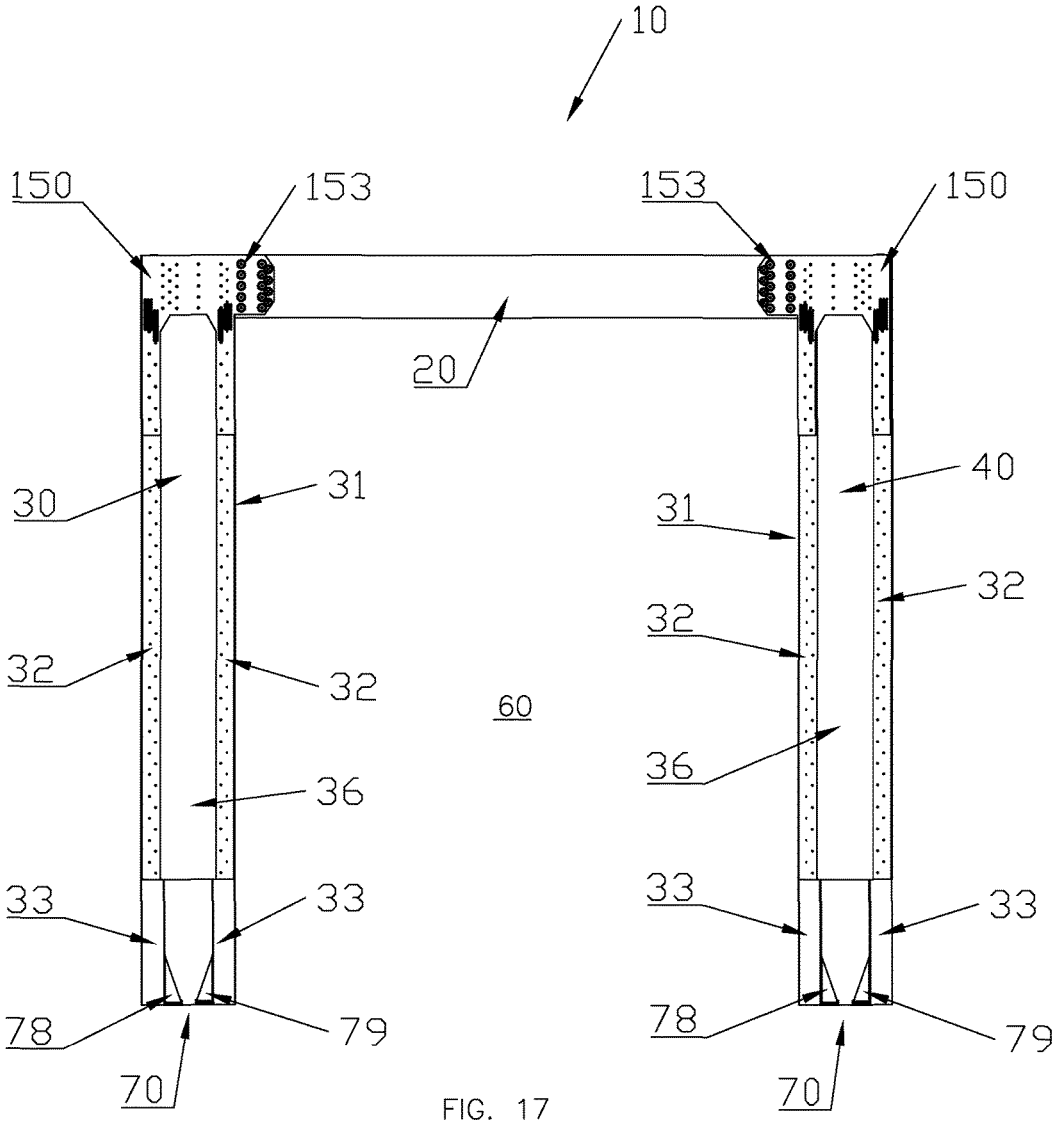
Figure 18:
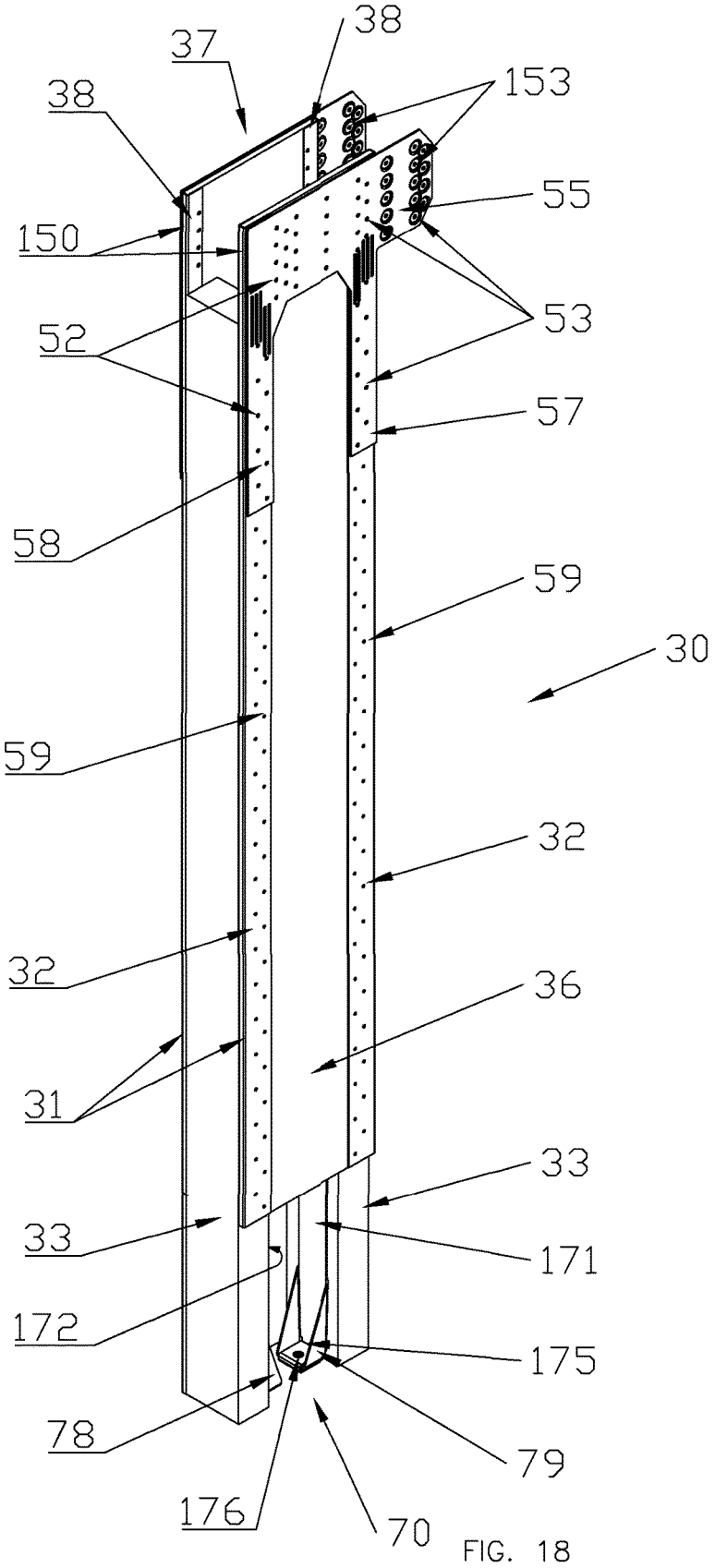
Figure 19:
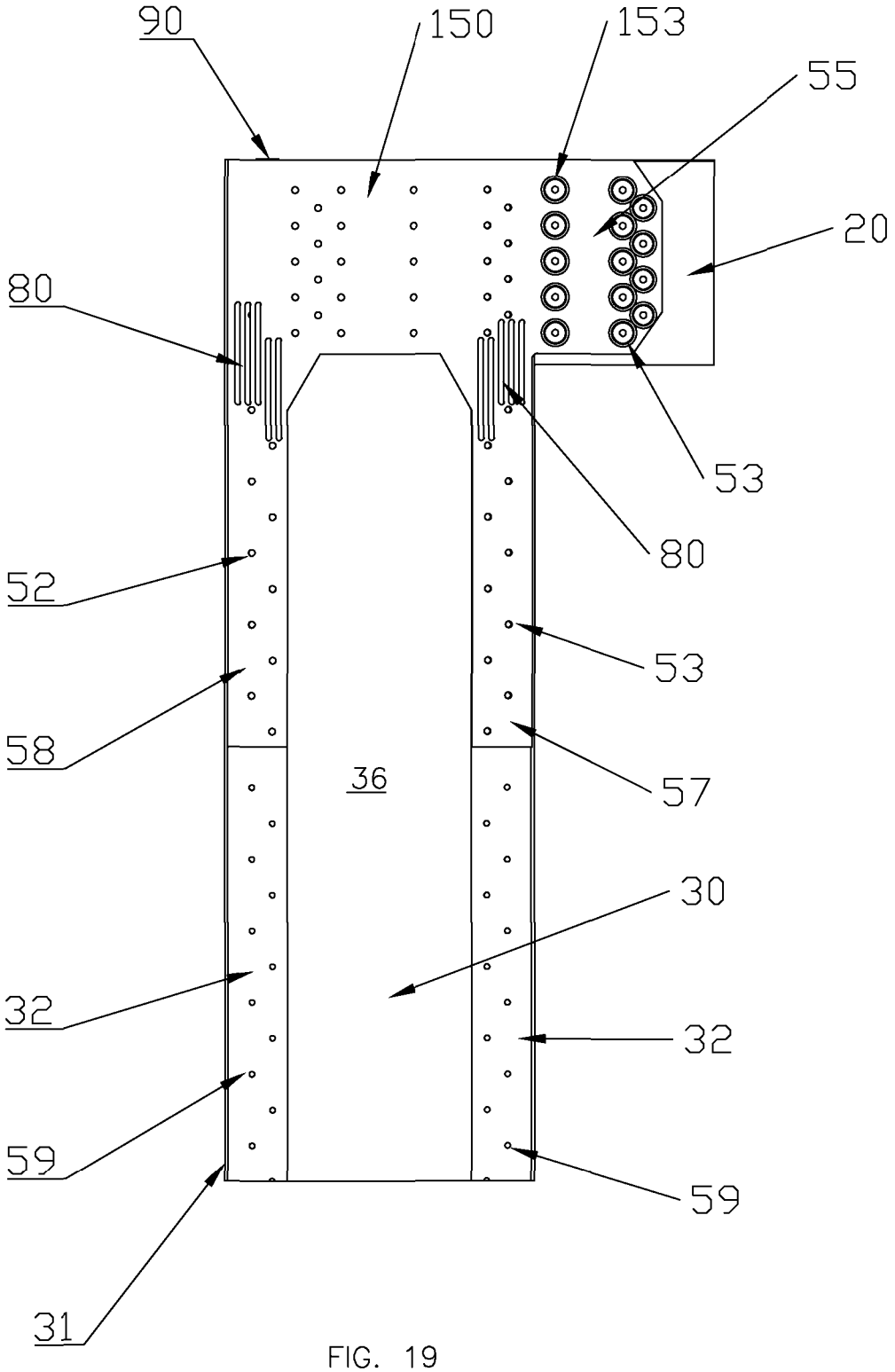
Figure 20:
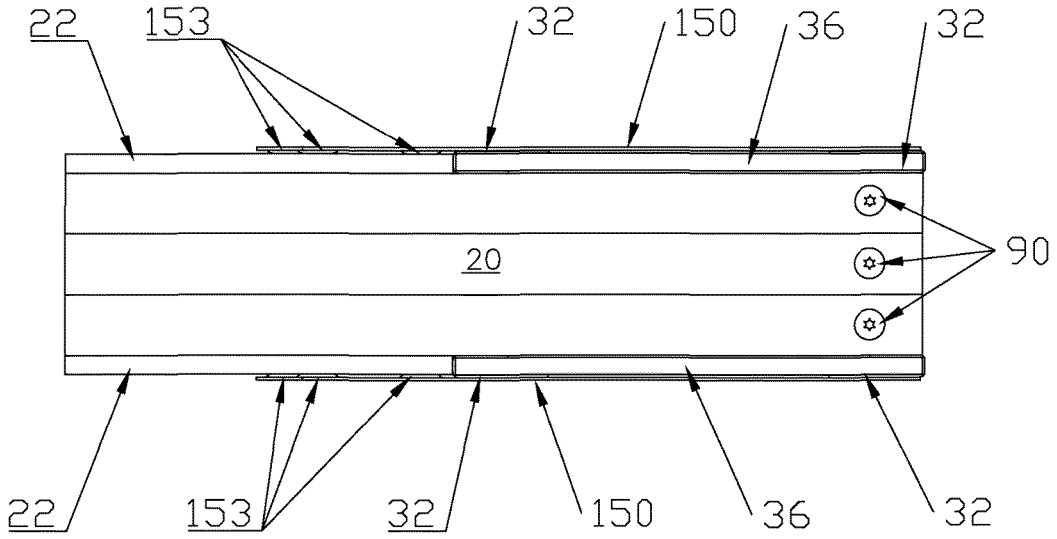
Figure 21:
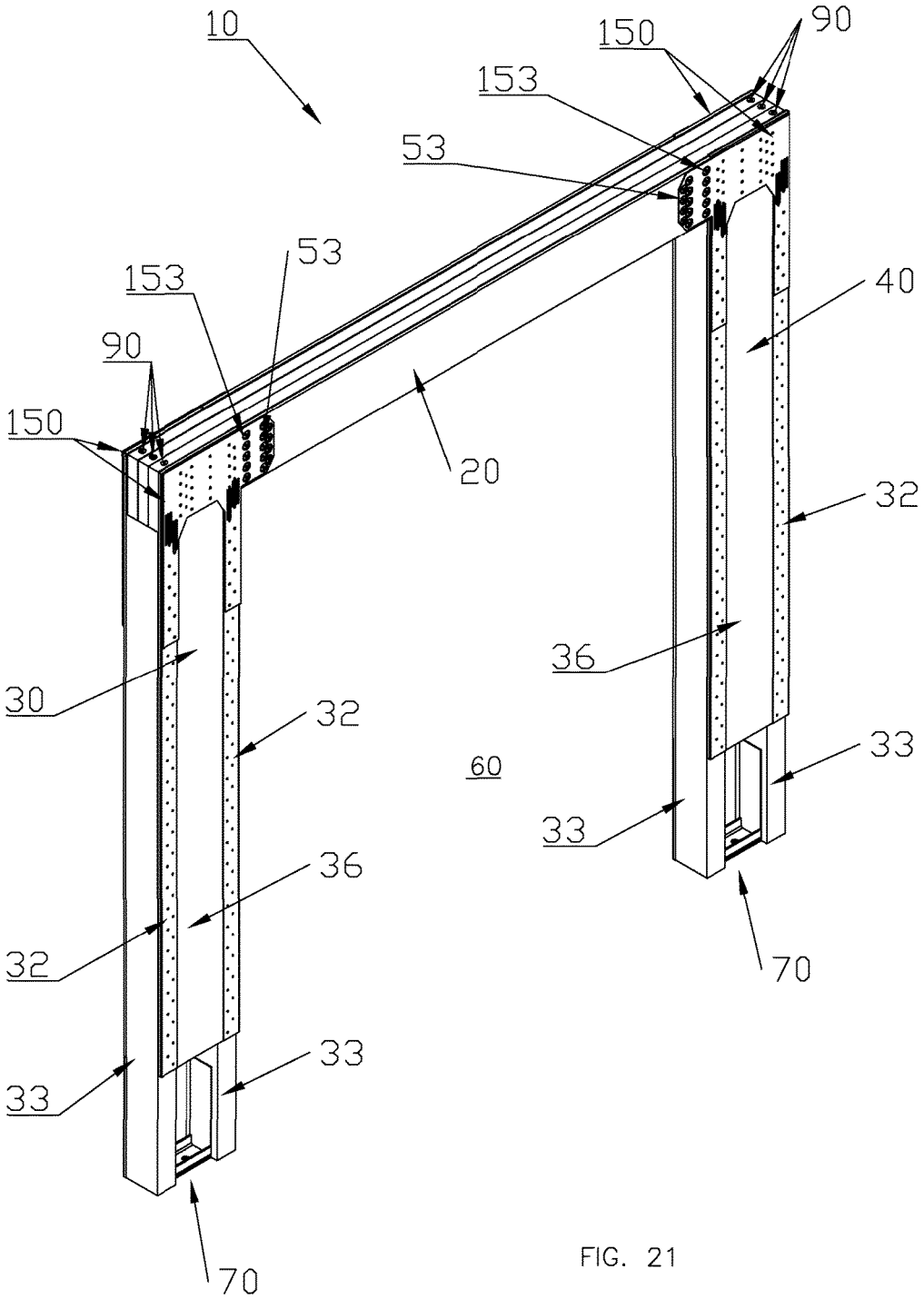
Figure 22:
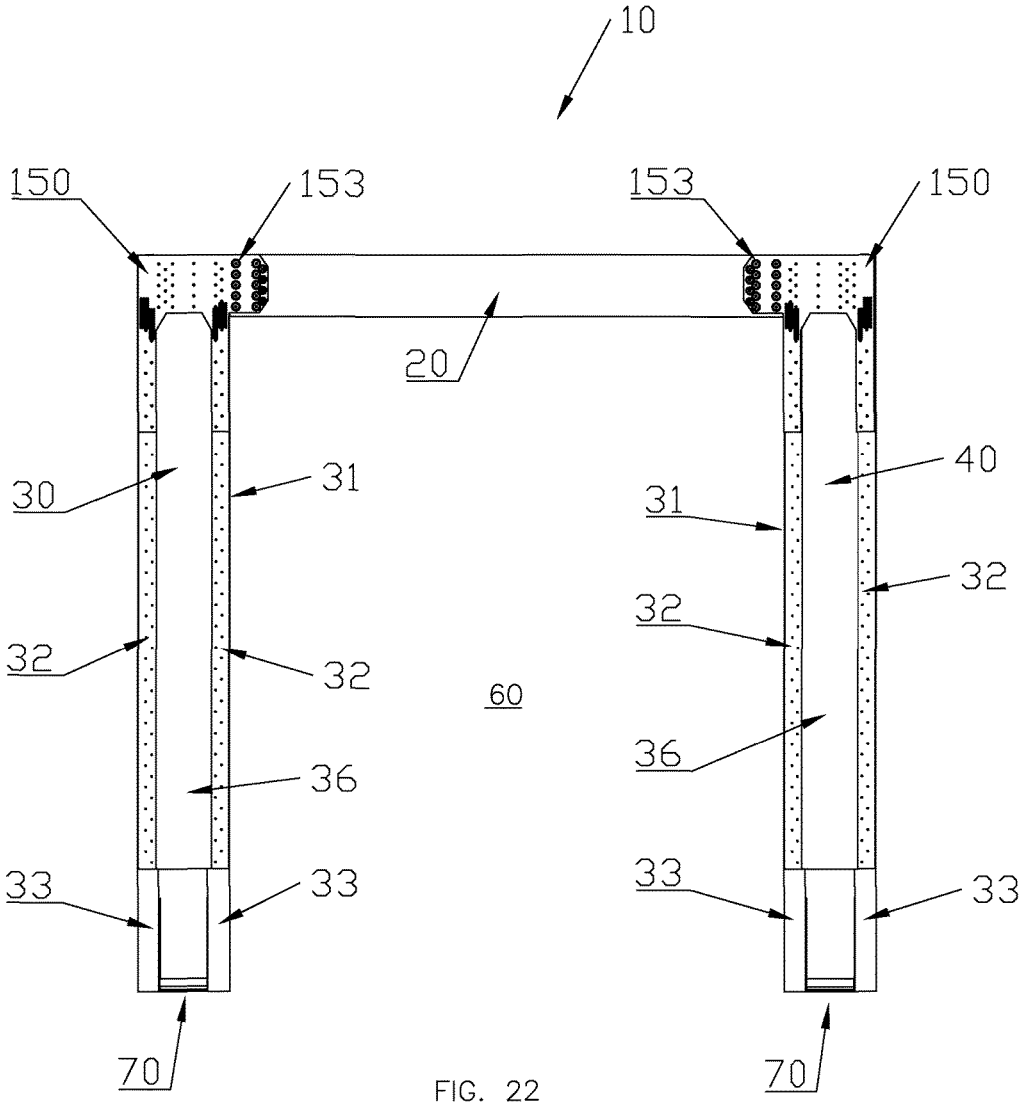
Figure 23:
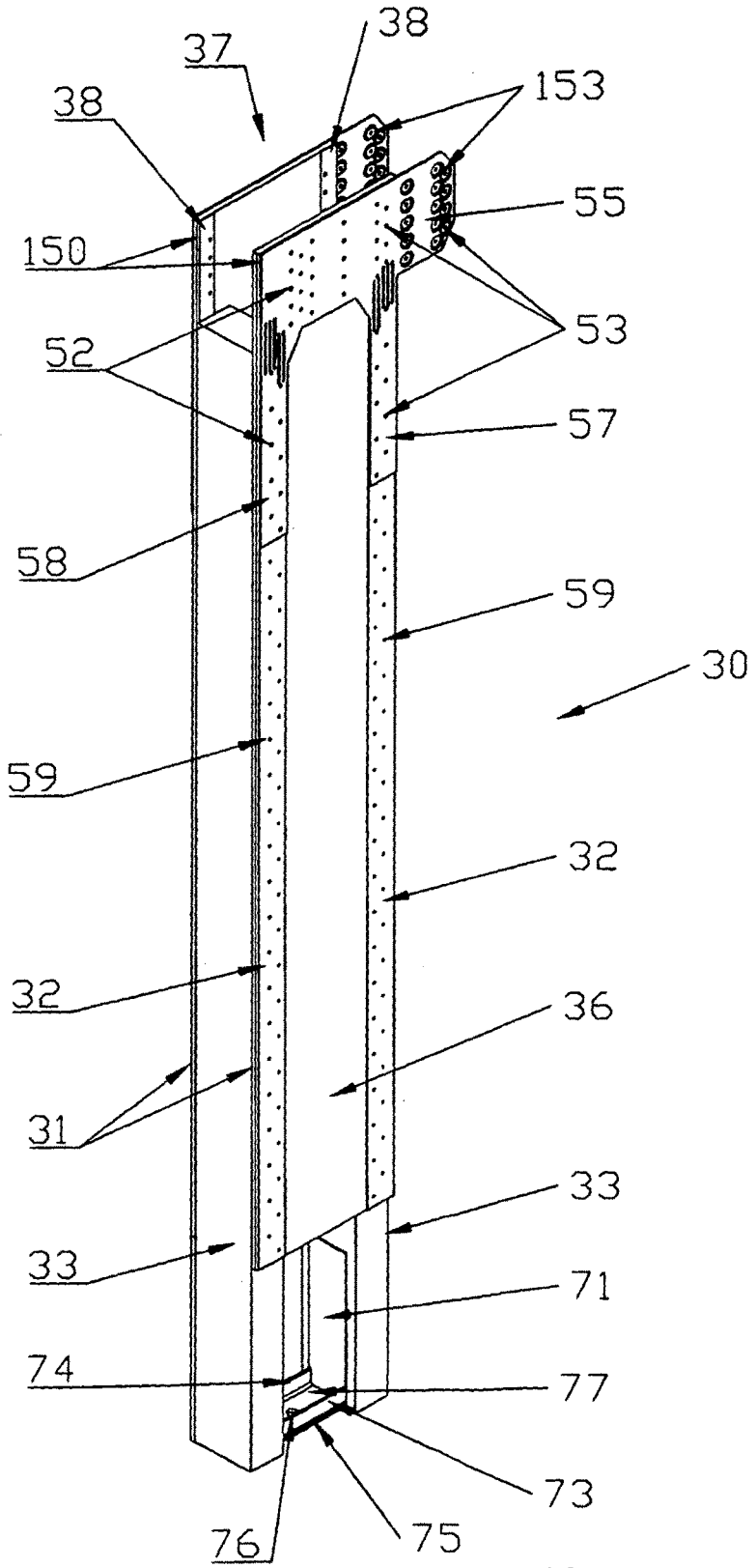
Figure 24:
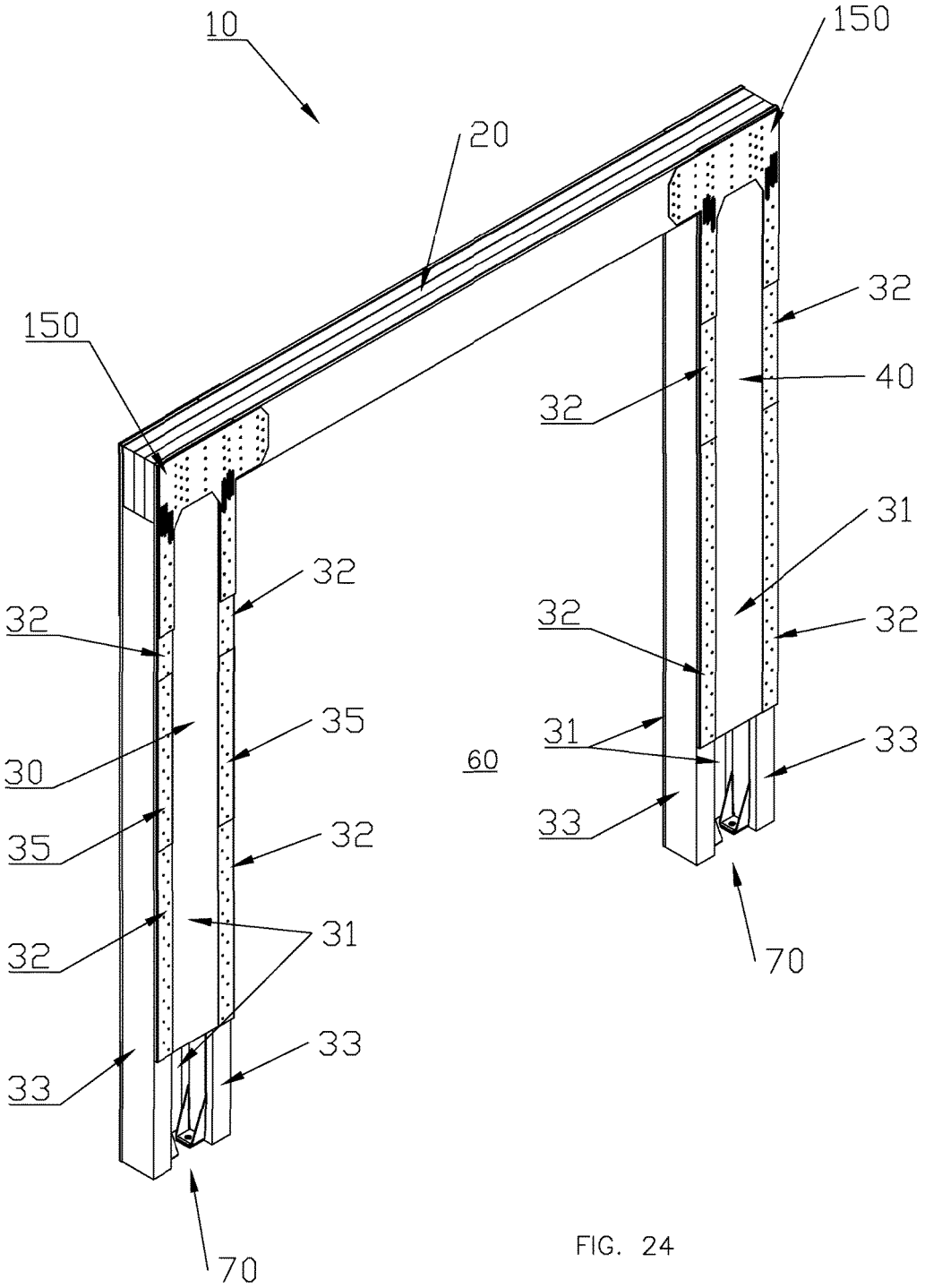
Figure 25:
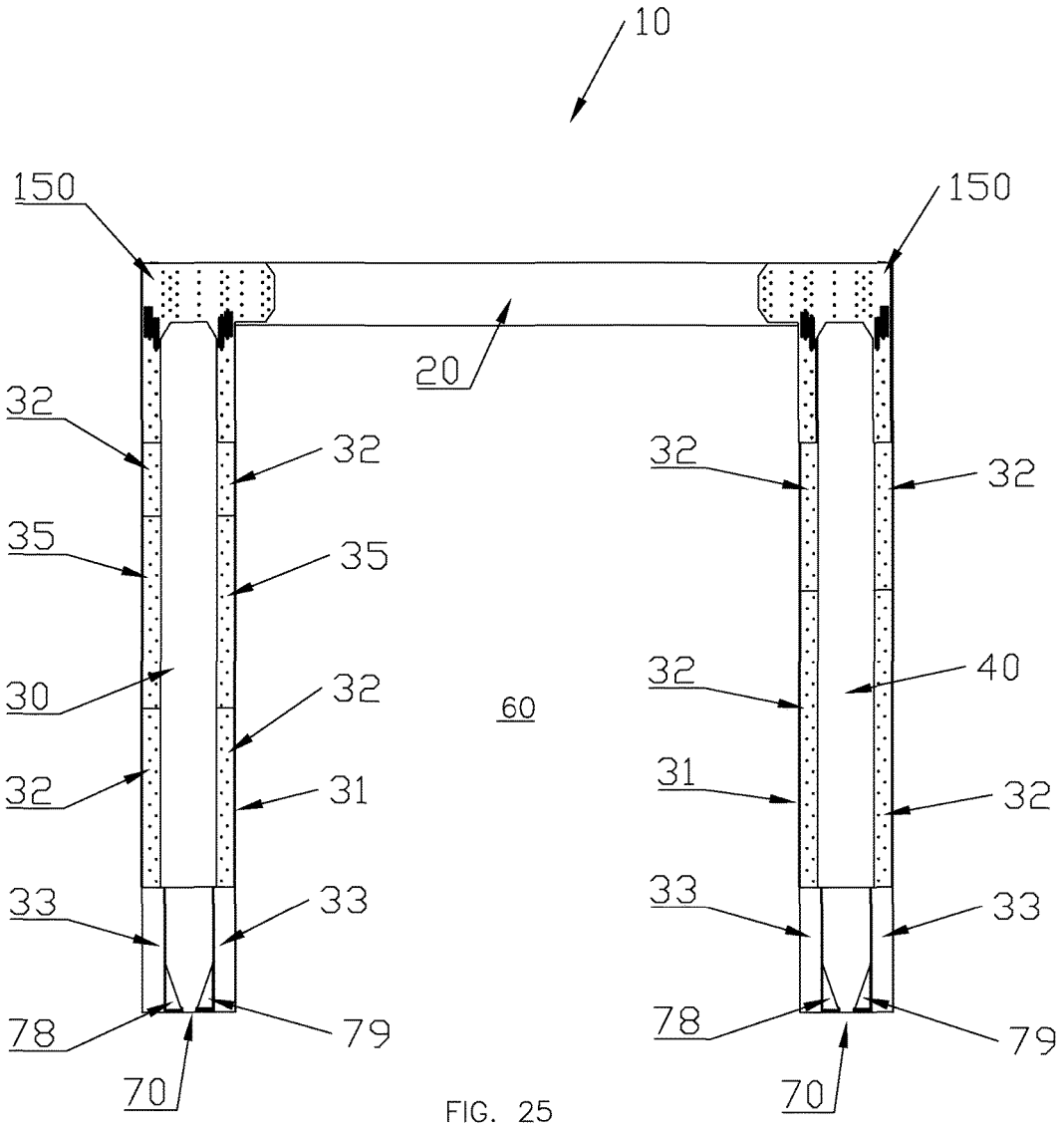
Figure 27:
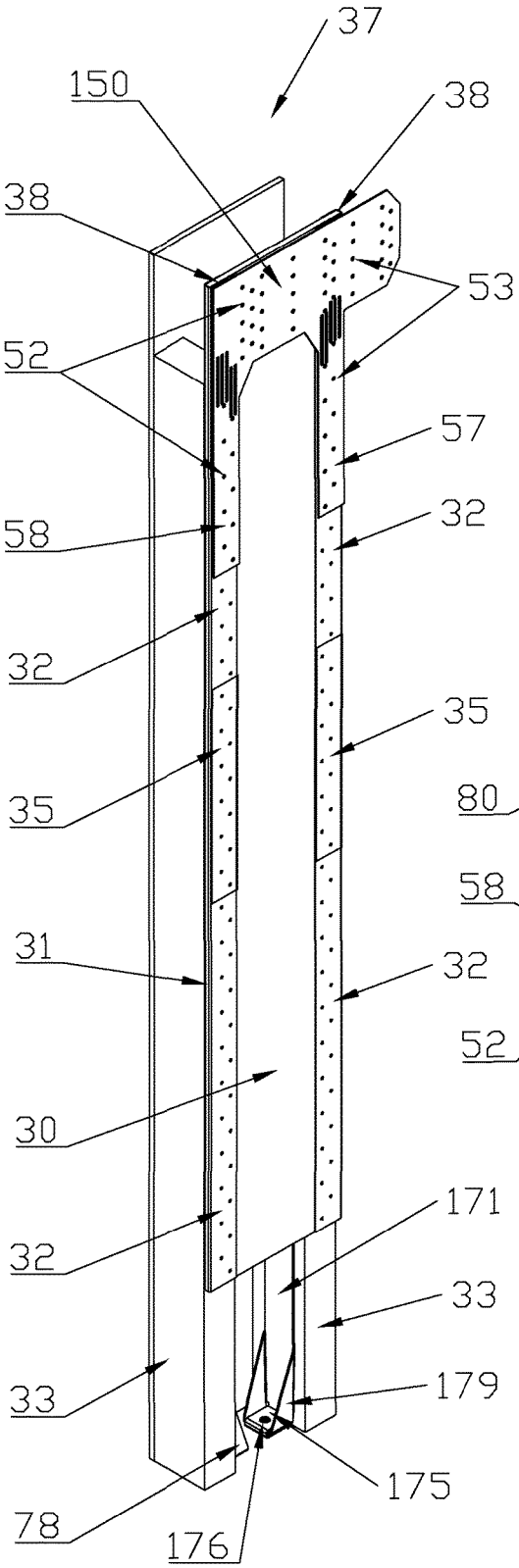
Figure 27:
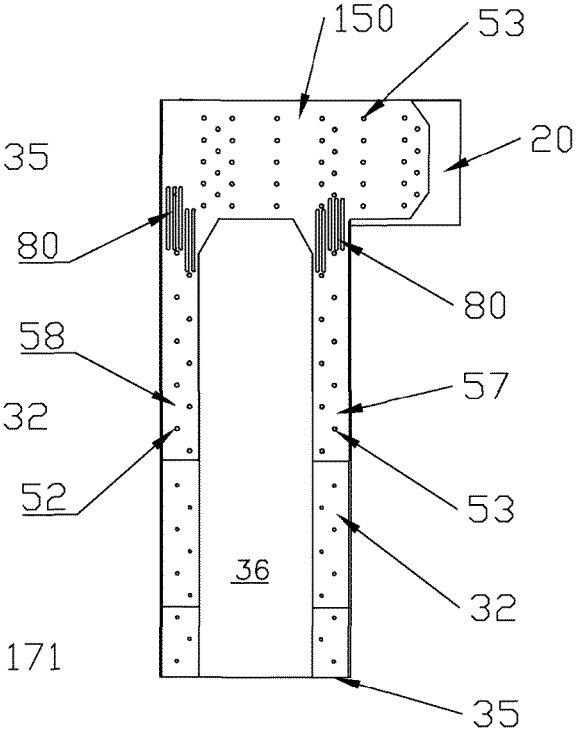
Figure 26:
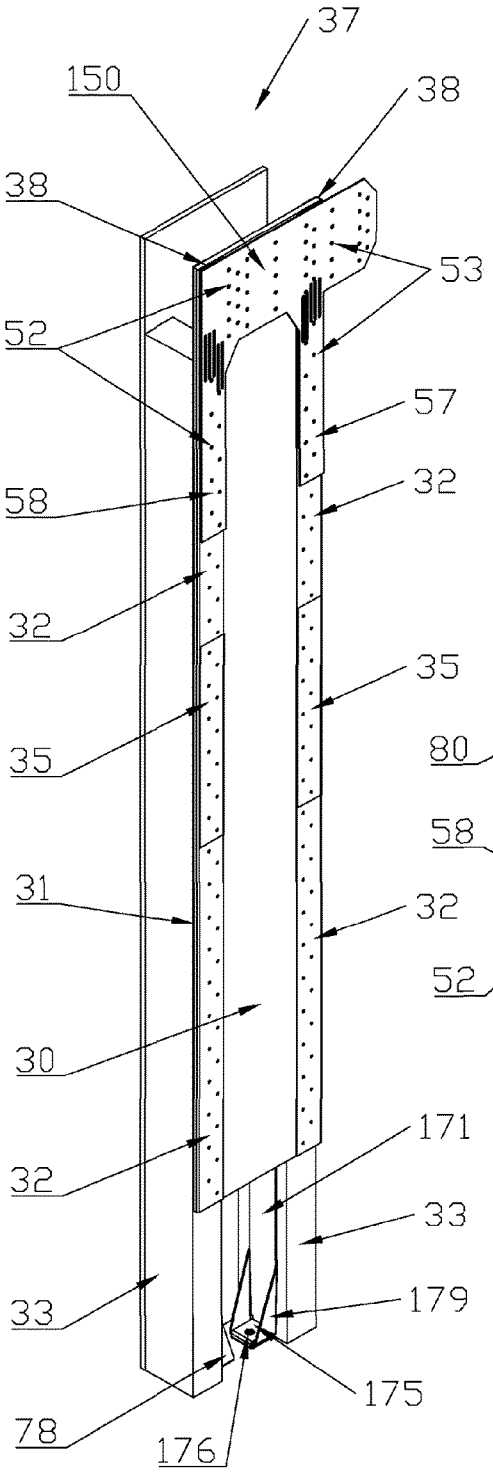
Figure 27:
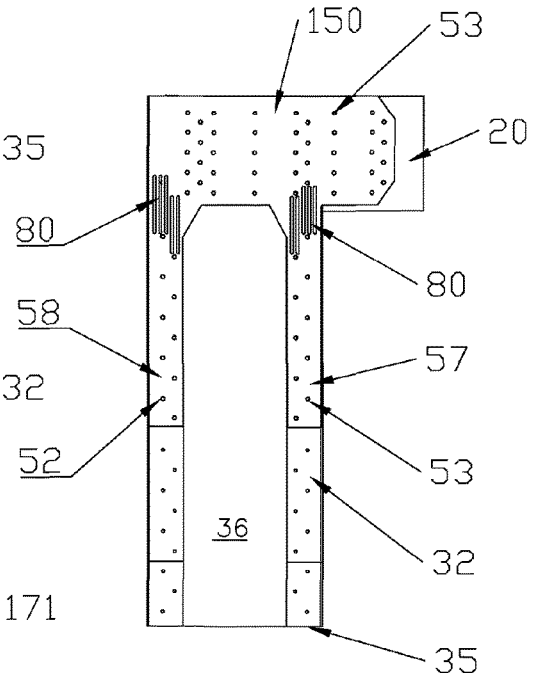
Figure 28:
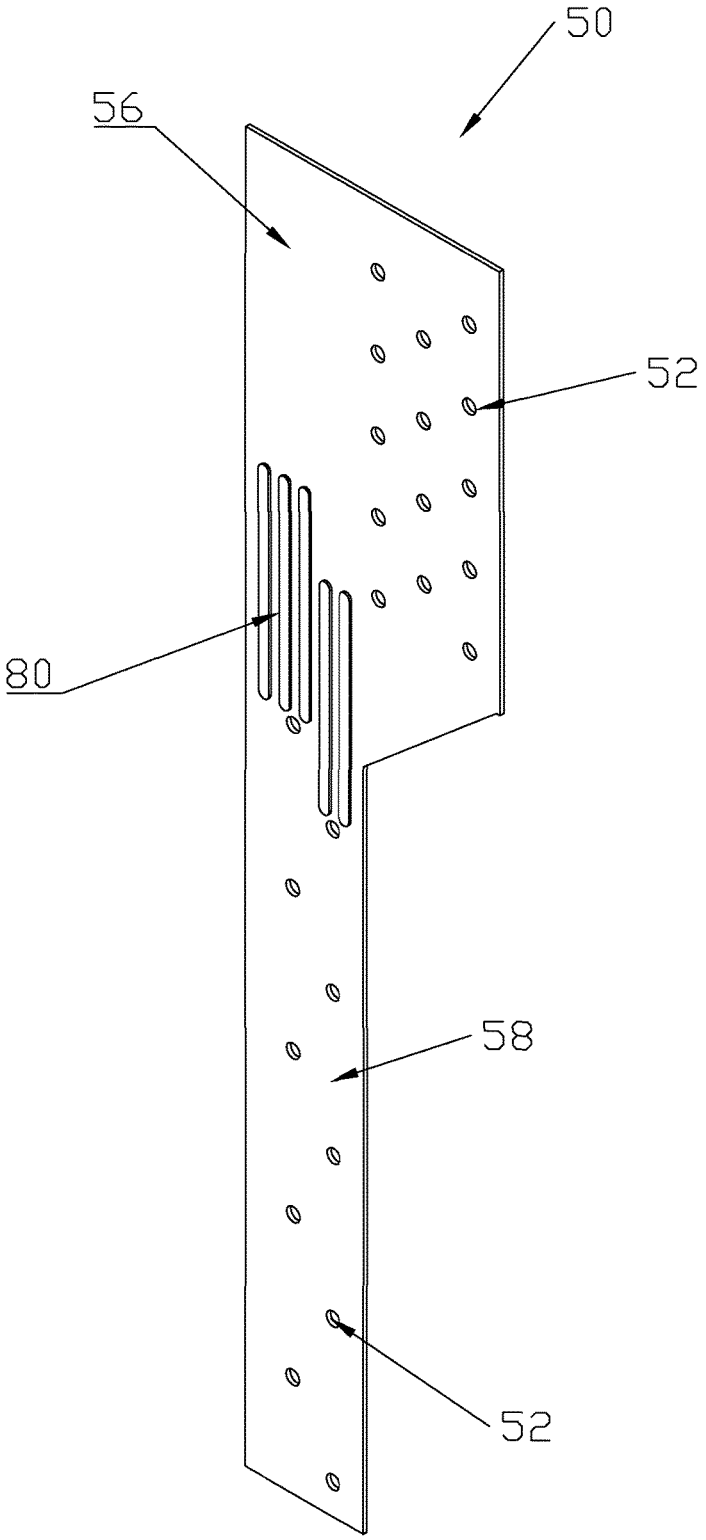

FIGS. 8*a* and 8*b* are schematic detailed perspective views of a column connector of the portal frame of FIG. 1;

FIGS. 9*a* and 9*b* are schematic detailed perspective views of a further embodiment, of column connector according to the present invention;

FIGS. 10*a* and 10*b* are schematic detailed perspective views of a yet further embodiment of column connector according to the present invention;

FIGS. 11*a* and 11*b* are schematic detailed perspective views of a further embodiment of column connector according to the present invention;

FIGS. 12*a* and 12*b* are schematic detailed perspective views of a yet further embodiment of column connector according to the present invention;

FIG. 13 is a schematic perspective view of a portal frame according to a further preferred embodiment of the present invention;

FIG. 14 is a schematic front elevation view of the portal frame of FIG. 13;

FIG. 15 is a schematic perspective view of a first column of the portal frame of FIG. 13;

FIG. 16 is a schematic perspective view of a portal frame according to a further preferred embodiment of the present invention;

FIG. 17 is a schematic front elevation view of the portal frame of FIG. 16;

FIG. 18 is a schematic perspective view of a first column of the portal frame of FIG. 16;

FIG. 19 is a schematic detailed front elevation view of the upper left hand end of the portal frame of FIG. 16;

FIG. 20 is a schematic detailed plan view from above of a right hand end of the portal frame of FIG. 16;

FIG. 21 is a schematic perspective view of a portal frame according to a further preferred embodiment of the present invention;

FIG. 22 is a schematic front elevation view of the portal frame of FIG. 21;

FIG. 23 is a schematic perspective view of a first column of the portal frame of FIG. 21;

FIG. 24 is a schematic perspective view of a portal frame according to a further preferred embodiment of the present invention;

FIG. 25 is a schematic front elevation view of the portal frame of FIG. 24;

FIG. 26 is a schematic perspective view of a first column of the portal frame of FIG. 24;

FIG. 27 is a schematic detailed front elevation view of the upper left hand end of the portal frame of FIG. 24; and FIG. 28 is a schematic perspective view of a further preferred embodiment of outer and/or inner frame connector for use in the portal frame according to the present invention.

Referring first to FIGS. 1 to 7*c*, there is illustrated a portal frame 10 according to a first preferred embodiment of the present invention. The portal frame 10 comprises a header 20, supported by a first column 30 and a second column 40. The header 20, first column 30 and second column 40 define a portal opening 60. The portal frame 10 comprises a first face 11 (frontal F in the Figures) and a second face 12 (rear R in the Figures).

The header 20, first column 30 and second column 40 are formed substantially of wood or a wood-based/wood-derived material (e.g. oriented strand board, wood composites, etc.). The header 20 preferably comprises a solid beam 21 and at least one wood or wood-based/wood-derived material panel 22. The solid beam 21 may be formed as a single piece or comprise a laminated structure (as shown). Fasteners 90, preferably screws (as shown), may be driven substantially vertically down into the header at or near each end (as shown in FIGS. 3*a* and 3*b*) to reinforce the header against splitting forces caused by use of the fasteners 45 described below.

The first column 30 is connected to the header 20 by means of at least one outer frame connector 50 and at least one inner frame connector 51. Preferably, the first column 30 may be connected to the header 20 by means of two outer frame connectors 50 and two inner frame connectors 51, one outer frame connector 50 and one inner frame connector 51 being affixed to the first face 11 and one outer frame connector 50 and one inner frame connector 51 being affixed to the second face 12.

The at least one outer frame connector 50 and at least one inner frame connector 51 are plate-like and/or do not envelop an end of the column and/or header.

Preferably, each of the at least one outer frame connector 50 and at least one inner frame connector 51 is adjacent to or only touches one of the first face 11 and the second face 12.

The first column 30 comprises at least one vertical stud 33 and at least one facing panel 31. Preferably, the first column 30 comprises two vertical studs 33 and two facing panels 31.

Each of the two facing panels 31 comprises a facing sheet 36 and at least one edging strip 32. Preferably, the facing sheet 36 is formed from wood or wood-based/wood-derived material and the edging strip 32 is formed from sheet metal. Preferably, the at least one edging strip 32 is shaped to enclose an edge of the at least one facing panel 31 (see FIGS. 6*c* and 7*b*). Preferably, the at least one facing panel 31 comprises one or a plurality of edging strips 32 arranged such that they enclose substantially the entire length of the lateral edges 38 of the facing sheet 36. Where two edging strips 32 are adjacent to each other along an edge (e.g. vertically, as shown in FIGS. 24 to 27), they may be attached to each other by means of one or more splice plates 35.

Each of the two facing panels 31 extends beyond an upper end 37 of the two vertical studs 33 (see FIG. 4) such that, when the header 20 is supported by the column 30, each of the two facing panels 31 is in contact with a face 23, 24 of the header 20.

Each of the two outer frame connectors 50 and two inner frame connectors 51 comprises a plurality of apertures 52, 53, through which fasteners 54 may be passed to fix the two outer frame connectors 50 and two inner frame connectors 51 to the header 20 and the column 30. Each of the two outer frame connectors 50 and two inner frame connectors 51 may overlie at least a portion of the plurality of edging strips 32 and/or splice plates 35. Preferably, an edging strip 32 may be integral to the at least one outer frame connector 50 and/or the at least one inner frame connector 51.

The two inner frame connectors 51 each comprise a column connecting portion 57 and a lateral header connecting portion 55 (as shown in FIG. 6*b*). The lateral header connecting portion 55 extends past a lateral edge of the column 30 and towards a centre of the header 20. The lateral header connecting portion 55 comprises at least one of the plurality of apertures 53 and the column connecting portion 57 comprises at least one of the plurality of apertures 53.

The two outer frame connectors 50 each comprise a column connecting portion 58 and a header connecting portion 56, and a return flange 54 (as shown in FIG. 6*a*). The header connecting portion 56 extends towards a centre of the header 20. The header connecting portion 56 comprises at least one of the plurality of apertures 52 and the column connecting portion 58 comprises at least one of the plurality of apertures 52.

Embossments 80 are preferably provided in the region of each inner/outer frame connector 50, 51 where the lateral header 55 or header 56 connecting portion transitions to the column connecting portion 57, 58.

Further or alternative embossments may beneficially employed in place of or in addition to the embossments 80.

Fasteners 45 may be used as appropriate to connect the components which make up the portal frame 10. Preferably, at least one fastener 45 is used in at least one of the plurality of apertures 53 of the lateral header connecting portion 55, and at least one fastener 45 is used in one of the at least one of the plurality of apertures 53 of the column connecting portion 57. Preferably, at least one fastener 45 is used in at least one of the plurality of apertures 52 of the header connecting portion 56, and at least one fastener 45 is used in at least one of the plurality of apertures 52 of the column connecting portion 58. More preferably, fasteners 45 are used in a plurality of the apertures 52, 53. For certain applications, fasteners 45 may be used in every one of the plurality of apertures 52, 53.

Fasteners 45 may also be used as appropriate to connect the components which make up the facing panel 31. Preferably, apertures 59 in the plurality of edging strips 32 are arranged to receive fasteners 45 such that they affix the edging strips 32 to the lateral edges 38 of the facing sheet 36.

Alternatively or additionally, adhesives may be beneficially employed in place of or as well as fasteners 45.

The second column 40 is preferably of substantially the same structure as the first column 30, save for handing (left/right) where necessary, and so like features are denoted by like reference numerals.

In use, moments generated under loading of the portal frame 10 due to lateral forces received by a building or other construction are resisted by the inner frame connector 51 and the outer frame connector 50 as a result of the substantially rigid connection created by fasteners 45 inserted through the apertures 52 in the lateral header connecting portion 55 and the header connecting portion 56, and those inserted through the apertures in the column connecting portions 57, 58.

Preferably, a majority of the moments generated under loading of the portal frame 10 are resisted by the inner connector 51 and the outer connector 50 in the manner described above.

It will be appreciated, therefore, that in the portal frame 10 according to the present invention, moment forces are primarily dealt with and dissipated by the substantially rigid connections formed between the header 20 and the top of each column 30, 40. The term "rigid" used herein refers to the substantially rigid connection achieved between the header 20 and the top of each column 30, 40. As a result, there is little or no requirement for a rigid connection between the bottom of each column 30, 40 and the foundation or other supporting surface. Indeed, the columns 30, 40 may be free to rotate about the foundation or other supporting surface.

The portal frame 10 may further comprise at least one support connector 70 for attachment of the first column 30 and/or second column 40 to a foundation or supporting surface.

Figure 2:
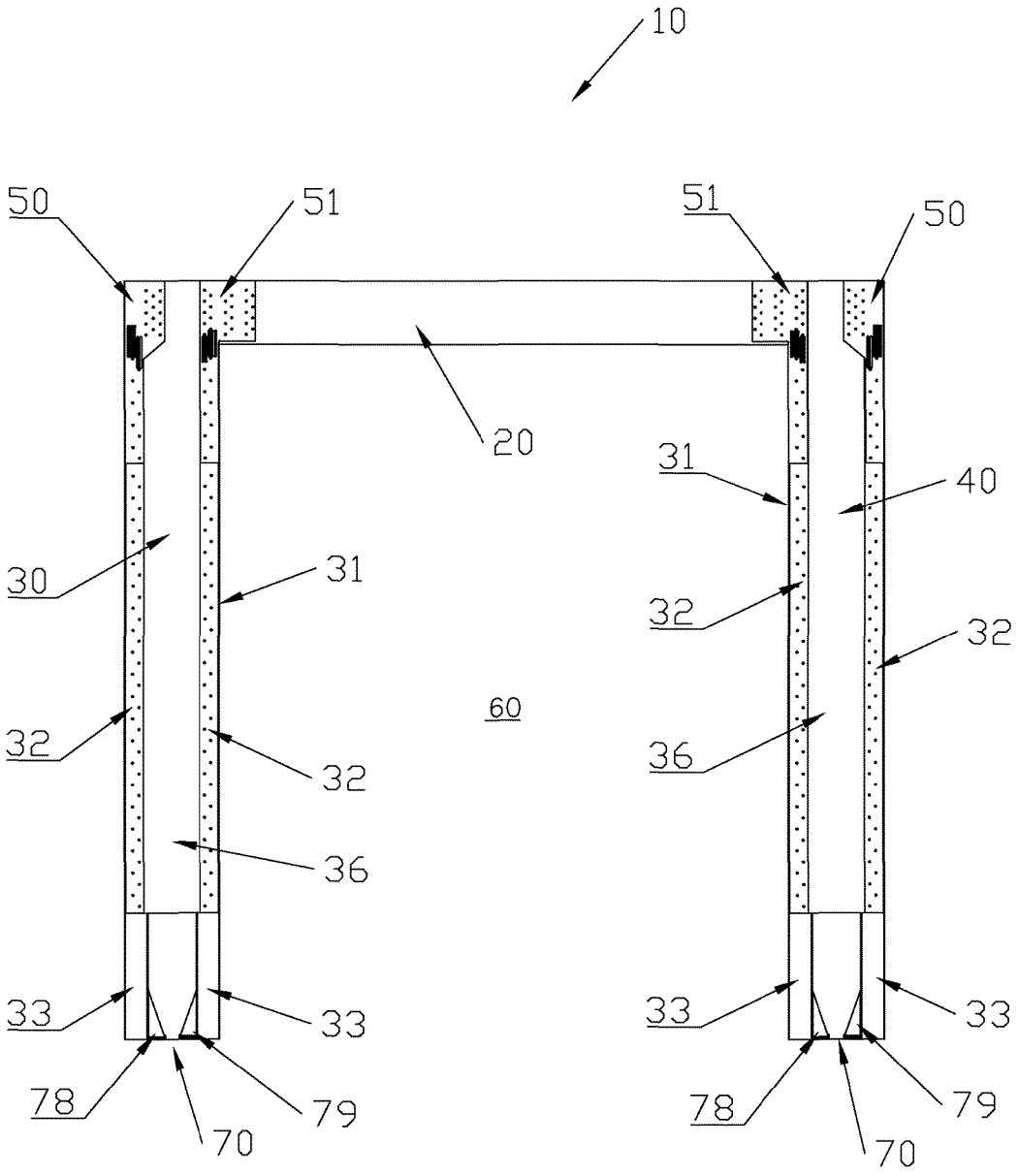
FIG. 2 is a schematic front elevation view of the portal frame of FIG. 1.

The support connector 70 may take any suitable form. For example, as illustrated in FIGS. 1, 2 and 4, the support connector 70 comprises two reinforced angle brackets 78, 79. Each angle bracket 78, 79 comprises an elongated back flange 172, 171 which may be fastened to the inner sides of the vertical studs 33, while a base flange 175 is provided for setting to a foundation or supporting surface.

An aperture 176 may be provided for receiving a bolt or other fastener for attachment of the first column 30 and/or second column 40 to a foundation or supporting surface.

Optionally, a washer or washer plate (not shown) may be provided above the base flange 175 to provide increased bearing capacity to resist lateral and uplift forces. Alternatively or additionally, the bearing capacity may be increased by way of doubling of material by the folding of an overlength base flange 175 back on itself.

FIGS. 8*a*, 8*b*, 9*a*, 9*b*, 10*a*, 10*b*, 11*a*, 11*b*, 12*a* and 12*b* illustrate alternative forms of support connector 70 for attachment of the first column 30 and/or second column 40 to a foundation or supporting surface.

In FIGS. 8*a* and 8*b*, the support connector 70 comprises an elongated strap which is bent so as to have upstanding side flanges 71, 72 which may be fastened to the inner sides of the vertical studs 33. The base flange portion 75 of the strap extending laterally between the upstanding side flanges 71, 72 bridges the gap between the inner sides of the vertical studs 33, and is provided for setting to a foundation or other supporting surface. Optional channel section washer 77 is provided inside and above the base flange portion 75, thereby increasing the bearing capacity to resist lateral and uplift forces.

An aperture 76 may be provided for receiving a bolt or other fastener for attachment of the first column 30 and/or second column 40 to a foundation or supporting surface.

Optionally, a washer or washer plate (not shown) may be provided inside and/or underneath the channel section 75 to provide increased bearing capacity to resist lateral and uplift forces.

In FIGS. 9*a* and 9*b*, the support connector 70 is not provided with a channel section washer. Again, it is planar and can be formed from sheet material. Optional washer/washer plate 77 is provided underneath the base flange 75 to provide increased bearing capacity to resist lateral and uplift forces. Optional washer/washer plate 77 may extend laterally beyond the ends of the base flange 75 and on under the "foot" of each vertical stud 33, as shown.

In FIGS. 10*a* and 10*b*, the support connector 70 bridges the gap between the vertical studs 33 and extends below, and is attachable to, the outer sides of the vertical studs 33. Optional washer/washer plate 77 is provided underneath the base flange 75 to provide increased bearing capacity to resist lateral and uplift forces.

In FIGS. 11*a* and 11*b*, the support connector 70 bridges the gap between, and is attachable to, the inner sides of the vertical studs 33. Optional washer/washer plate 77 is provided to overlie the base flange 75 to provide increased bearing capacity to resist lateral and uplift forces.

In FIGS. 12*a* and 12*b*, the support connector 70 bridges the gap between the vertical studs 33 and extends below and is attachable to the outer sides of the vertical studs 33. Optional washer/washer plate 77 is provided to overlie the base flange 75 between the vertical studs 33 to provide increased bearing capacity to resist lateral and uplift forces.

Optionally, the washer/washer plate 77 may be elongated with upturned ends which serve as flanges and may be fastened to the inner sides of the vertical studs 33 (not shown).

In all embodiments, the at least one facing panel 31 may stop short of the foot of the at least one vertical stud 33 (as shown) to allow access to the at least one support connector 70. In this case, a facing panel portion (not shown) may be provided to close the open area at the foot of the column 30, 40.

The columns 30, 40 will typically be hollow, and so insulation is provided (not shown) to increase the barrier to thermal and sound transmission. Where the at least one facing panel 31 stops short of the foot of the at least one vertical stud 33 to allow access to the at least one support connector 70, insulation may be provided as loose fill for retrofit filling, or may be attached to the inside of the closing facing panel portion.

In a further preferred embodiment, shown in FIGS. 13 to 15, the first column 30 (and optionally second column 40) is/are connected to a foundation or other supporting surface using the support connector of FIGS. 8*a* and 8*b*. This further preferred embodiment is otherwise as described in the first preferred embodiment.

In a further preferred embodiment, shown in FIGS. 16 to 20, the first column 30 (and optionally second column 40) is connected to the header 20 by means of at least one combined frame connector 150. Preferably, the first column 30 (and optionally second column 40) may be connected to the header 20 by means of two combined frame connectors 150, one each being affixed to the first face 11 and the second face 12 of the portal frame 10. "Dimpled" features 153 are provided on each combined frame connector 150 around the apertures 53 in the area spaced laterally of the column, in use, so as to take up the gap between the combined frame connector 150 and the header 20 (as can best be seen in FIG. 20). This further preferred embodiment is otherwise as described in the first preferred embodiment.

In a further preferred embodiment, shown in FIGS. 21 to 23, and similar to that shown in FIGS. 16 to 20, the first column 30 (and optionally second column 40) is connected to the header 20 by means of at least one combined frame connector 150. However, the first column 30 (and optionally second column 40) is/are connected to a foundation or other supporting surface using the support connector of FIGS. 8*a* and 8*b*. This further preferred embodiment is otherwise as described in the preferred embodiment of FIGS. 16 to 20.

In a further preferred embodiment, shown in FIGS. 21 to 23, and similar to that shown in FIGS. 16 to 20, the first column 30 (and optionally second column 40) is connected to the header 20 by means of at least one combined frame connector 150. However, the edge strips are multi-part and a splice plate 35 is used to connect these (not shown on the right-hand column 40). This further preferred embodiment is otherwise as described in the preferred embodiment of FIGS. 16 to 20.

FIG. 28 illustrates an alternative form of outer frame connector 50. As in the preferred embodiment describe above with reference to FIG. 6*a*, the outer frame connector 50 comprises a column connecting portion 58 and a header connecting portion 56. However, in this alternative embodiment, no return flange is provided. The header connecting portion 56 comprises at least one of the plurality of apertures 52 and the column connecting portion 58 comprises at least one of the plurality of apertures 52. Embossments 80 are preferably provided in the region where the header connecting portion 56 transitions to the column connecting portion 58. Further or alternative embossments may beneficially employed in place of or in addition to the embossments 80.

In a further preferred embodiment (not shown), the header 20 comprises a solid beam as illustrated in FIG. 2, but one not provided with a wood or wood-based/wood-derived material panel 22. Instead, the laterally extending portion of the lateral header connecting portion 55 or header connecting portion 56 may bent out of the plane of the column connecting portion 57, 58 such that a face of the laterally extending portion is coplanar with a front face of the header 20.

According to a yet further embodiment of the present invention (not shown), a portal frame as described in any preceding embodiment may further comprise at least one intermediate column. The header, first column, second column and at least one intermediate column define a plurality of portal openings.

It will be appreciated from the foregoing that the portal frame 10 according to the present invention is not limited to ground floor use, and may be beneficially employed also/instead in upper stories of a construction.

Whilst preferred embodiments of the present invention have been described above and illustrated in the drawings, these are by way of example only and non-limiting. It will be appreciated by those skilled in the art that many alternatives are possible within the ambit of the invention. For example, the header may alternatively be of hollow construction, and may comprise insulation in the hollow. The second column may differ in structure to the first column, for example the second column may comprise a solid strut. The various embodiments of frame connector (combined, inner and/or outer), edging strip and fasteners (and indeed all parts of the portal frame) may be optimised by reducing the number of discrete parts, such as by way of integrating the edging strip with the frame connector, for example. As such, the true scope of the invention is that as set out in the appended claims.

Each feature disclosed in this specification (including the accompanying claims and drawings), may be replaced by alternative features serving the same, equivalent or similar purpose, unless expressly stated otherwise, as set forth in the appended claims. Thus, unless expressly stated otherwise, each feature disclosed is one example only of a generic series of equivalent or similar features, as set forth in the appended claims. In addition, all of the features disclosed in this specification (including the accompanying claims and drawings), and/or all of the steps of any method or process so disclosed, may be combined in any combination, except combinations where at least some of such features and/or steps are mutually exclusive, as set forth in the appended claims. Accordingly, while many different embodiments of the present invention have been described above, any one or more or all of the features described, illustrated and/or claimed in the appended claims may be used in isolation or in various combinations in any embodiment, as set forth in the appended claims. As such, any one or more feature may be removed, substituted and/or added to any of the feature combinations described, illustrated and/or claimed, as set forth in the appended claims. For the avoidance of doubt, any one or more of the features of any embodiment may be combined and/or used separately in a different embodiment with any other feature or features from any of the embodiments, as set forth in the appended claims.

The invention claimed is:

1. A portal frame for at least partially framing a portal opening in a structure requiring a higher level of resistance to forces received or imposed thereon than a wall panel frame, the portal frame, comprising:

at least one header;

at least a first column;

at least two frame connectors configured to rigidly connect the first column to the at least one header;

at least one header fastener configured to fasten each frame connector to the at least one header;

at least one column fastener configured to fasten each frame connector to the first column, wherein:

the first column is formed of wood or a wood-based/wood-derived material, and at least one of a first one or a second one of the at least two frame connectors comprises:

a lateral header connecting portion extending beyond a lateral edge of the first column adjacent the portal opening in a direction towards a center of the at least one header; and a column connecting portion extending along at least a portion of a height of the first column, wherein:

at least one of the at least one header fastener is positioned in a region of the lateral header connecting portion, wherein the first one or the second one of the at least two frame connectors is used on a front facing side of the portal frame and the other of the first or the second one of the at least two frame connectors is used on a rear facing side of the portal frame, and wherein one of the first one or the second one at least two frame connectors is of a different shape to that of the other or others of the at least two frame connectors.

2. The portal frame as claimed in claim 1 further comprising:

at least a second column;

at least one additional frame connector for rigidly connecting the at least second column to the at least one header;

at least one additional header fastener configured to fasten the additional frame connector to the at least one header;

at least one additional column fastener configured to fasten the additional frame connector to the at least second column, wherein:

the at least second column is formed of wood or a wood-based/wood-derived material, and the at least one additional frame connector comprises:

an additional lateral header connecting portion extending beyond a lateral edge of the second column in a direction towards the center of the at least one header; and an additional column connecting portion extending along at least a portion of a height of the at least second column, wherein:

the additional lateral header connecting portion comprises at least one of the at least one additional header fastener.

3. The portal frame as claimed in claim 1 wherein at least one of the at least two frame connectors is formed from sheet metal.

4. The portal frame as claimed in claim 1 wherein at least one of the at least two frame connectors is plate-like.

5. The portal frame as claimed in claim 1 wherein at least one of the at least two frame connectors does not envelop an end of the at least one header and/or the at least first or second column.

6. The portal frame as claimed in claim 1 wherein at least one of the at least two frame connectors is adjacent to, or only touches one of, a front facing side or a rear facing side of the portal frame.

7. The portal frame as claimed in claim 1 wherein the lateral header connecting portion is not coplanar with an adjacent section of at least one of the at least two frame connectors.

8. The portal frame as claimed in claim 1 wherein the first column comprises at least one vertical stud and at least one facing panel.

9. The portal frame as claimed in claim 8 wherein the at least one facing panel comprises a sheet of wood or wood-derived/wood-based material and at least one edging strip.

10. The portal frame as claimed in claim 9 wherein the at least one edging strip is shaped to enclose an edge of the at least one facing panel or sheet.

11. The portal frame as claimed in claim 9 wherein at least one of the at least two frame connectors comprises the at least one edging strip.

12. The portal frame as claimed in claim 8 wherein the at least one facing panel extends beyond an upper end of the at least one vertical stud.

13. The portal frame as claimed in claim 1 wherein the at least one header comprises a solid beam.

14. The portal frame as claimed in claim 13 wherein the at least one header is formed of wood or a wood-based/wood-derived material.

15. The portal frame as claimed in claim 1 wherein the at least one header is hollow and/or a composite structure.

16. The portal frame as claimed in claim 1 wherein the at least one header further comprises at least one wood or wood-derived/wood-based material panel.

17. The portal frame as claimed in claim 1 wherein the at least one header is part of another and/or existing structure.

18. The portal frame as claimed in claim 1 further comprising at least one support connector for attaching the first column to a foundation or other supporting surface.

19. The portal frame as claimed in claim 1 wherein the portal frame is further configured to resist moments generated under loading of the portal frame in use by substantially rigid connection of the at least one header to the first column using at least one of the at least two frame connectors.

20. The portal frame as claimed in claim 19 wherein the portal frame is further configured to resist moments generated under loading of the portal frame in use by substantially rigid connection of the at least one header to the first column and the at least second column using a plurality of the at least one of the at least two frame connectors.

21. The portal frame as claimed in claim 1 wherein at least one of the first one or the second one of the at least two frame connectors is used at an inner edge of the column of the portal frame and at least one of the first one or the second one of the at least two frame connectors is used at an outer edge of the column of the portal frame.

22. The portal frame as claimed in claim 1 wherein at least one of the at least two frame connectors is configured to connect the at least one header to the first column such that the at least one header extends past the lateral edge of the column, and wherein the at least one of the at least two frame connectors further comprises:

the lateral header connecting portion extending in use along a portion of the header and beyond the lateral edge of the first column.

23. The portal frame of claim 1 wherein each of the first one and the second one of the at least two frame connectors comprises the lateral header connecting portion extending beyond the lateral edge of the first column adjacent the portal opening in a direction towards the center of the at least one header.

24. The portal frame of claim 1 wherein the different shape comprises the first one or the second one of the at least two frame connectors comprising a mirror shape of the other of the at least two frame connectors.

* * * * *